US009950541B2

(12) United States Patent
Duckett et al.

(10) Patent No.: US 9,950,541 B2
(45) Date of Patent: Apr. 24, 2018

(54) THERMAL PRINTER AND COMPONENTS

(71) Applicant: Avery Dennison Retail Information Services, LLC, Mentor, OH (US)

(72) Inventors: Jeanne F. Duckett, Franklin, OH (US); Johannes Lenkl, Freising (DE); Timothy L. Brown, Dayton, OH (US); Mitchell G. Stern, Centerville, OH (US); Lance D. Neuhard, New Carlisle, OH (US)

(73) Assignee: AVERY DENNISON RETAIL INFORMATION SERVICES, LLC, Mentor, OH (US)

( * ) Notice: Subject to any disclaimer, the term of this patent is extended or adjusted under 35 U.S.C. 154(b) by 0 days.

(21) Appl. No.: 15/164,963

(22) Filed: May 26, 2016

(65) Prior Publication Data

US 2016/0347082 A1 Dec. 1, 2016

Related U.S. Application Data

(60) Provisional application No. 62/168,446, filed on May 29, 2015.

(51) Int. Cl.
*B41J 11/24* (2006.01)
*B41J 15/02* (2006.01)
(Continued)

(52) U.S. Cl.
CPC ..... *B41J 2/355* (2013.01); *B41J 11/0095* (2013.01); *B41J 11/04* (2013.01); *B41J 15/042* (2013.01);
(Continued)

(58) Field of Classification Search
CPC ... B41J 11/00; B41J 11/04; B41J 11/24; B41J 2202/00; B41J 2202/30; B41J 2202/31;
(Continued)

(56) References Cited

U.S. PATENT DOCUMENTS 2,062,108 A * 11/1936 Rickerson ..... F16D 1/108 403/348
4,297,039 A 10/1981 Lees
(Continued)

FOREIGN PATENT DOCUMENTS

EP 2193926 6/2010
FR 2484917 12/1981
(Continued)

OTHER PUBLICATIONS

International Search Report and Written Opinion dated Jan. 4, 2016 for IA No. PCT/US2015/055404.
(Continued)

*Primary Examiner* — Geoffrey Mruk
*Assistant Examiner* — Scott A Richmond
(74) *Attorney, Agent, or Firm* — Avery Dennison Retail Information Services, LLC

(57) ABSTRACT

The present invention provides for an improved printer provides a user with a simple, intuitive user-friendly touch-screen interface, is easy to assemble, and has a low cost to repair. The printer comprises a platen roller that can be changed without tools via the use of a bayonet connector, and an easy change print head that mechanically guides the print head into the carrier via mechanical guiding pins. Further, the printer comprises a universal supply holder to accommodate different sizes of inner diameter cores for tag and laminated supplies. The printer also discloses a ribbon spindle that accommodates both a cardboard core and a plastic core on the same printer device. Additionally, the printer discloses a media low sensor for providing a low supply indicator, and a gap sensor that comprises an LED array and a resistor array for gap sensing across the supply web.

13 Claims, 33 Drawing Sheets

(51) Int. Cl.

| | |
|---|---|
| ***B41J 15/04*** | (2006.01) |
| ***B41J 2/355*** | (2006.01) |
| ***B41J 11/00*** | (2006.01) |
| ***B41J 11/04*** | (2006.01) |
| ***B41J 17/24*** | (2006.01) |
| ***B41J 25/34*** | (2006.01) |
| ***B65H 75/24*** | (2006.01) |
| ***B65H 26/08*** | (2006.01) |

(52) U.S. Cl.
CPC ..... *B41J 17/24* (2013.01); *B41J 25/34* (2013.01); *B65H 26/08* (2013.01); *B65H 75/242* (2013.01); *B65H 2301/4132* (2013.01); *B65H 2511/142* (2013.01); *B65H 2551/18* (2013.01); *B65H 2557/11* (2013.01); *B65H 2801/12* (2013.01)

(58) Field of Classification Search
CPC ... B41J 15/00; B41J 15/02; B41J 15/04; B41J 15/042; B41J 15/044; B41J 17/24; B65H 75/242
See application file for complete search history.

(56) References Cited

U.S. PATENT DOCUMENTS

| | | | | |
|---|---|---|---|---|
| 4,667,210 | A * | 5/1987 | Matsuura | B41J 2/33575 346/139 R |
| D362,673 | S | 9/1995 | Yamamoto | |
| 5,745,146 | A * | 4/1998 | Durst | B41J 2/345 347/192 |
| 5,779,372 | A * | 7/1998 | Jorgensen | B41J 17/24 400/191 |
| 6,236,486 | B1 | 5/2001 | Nocker | |
| 6,409,401 | B1 | 6/2002 | Petteruti et al. | |
| 6,593,853 | B1 | 7/2003 | Barrett et al. | |
| 6,963,351 | B2 | 11/2005 | Squires et al. | |
| D528,151 | S | 9/2006 | Hattori | |
| D528,587 | S | 9/2006 | Nakaeda | |
| 7,114,654 | B2 | 10/2006 | Chapman | |
| 7,190,270 | B2 | 3/2007 | Brown | |
| D579,043 | S | 10/2008 | Hattori et al. | |
| 7,481,371 | B2 | 1/2009 | Heidorn | |
| 7,936,252 | B2 | 5/2011 | Donato | |
| D641,394 | S | 7/2011 | Inada | |
| 8,097,111 | B2 | 1/2012 | Stern | |
| 8,207,824 | B2 | 6/2012 | Keeton et al. | |
| 8,305,198 | B2 | 11/2012 | Donato | |
| 8,365,788 | B2 | 2/2013 | Le | |
| 8,393,540 | B2 | 3/2013 | Alleshouse | |
| 8,472,046 | B2 | 6/2013 | Hoffman et al. | |
| D689,542 | S | 9/2013 | Klocke et al. | |
| 8,544,740 | B2 | 10/2013 | Torchaski et al. | |
| D694,319 | S | 11/2013 | Nakagawa | |
| 2005/0025483 | A1 | 2/2005 | Gurevich et al. | |
| 2005/0029350 | A1 | 2/2005 | Jusas et al. | |
| 2005/0058483 | A1 | 3/2005 | Chapman et al. | |
| 2005/0116034 | A1 | 6/2005 | Satake et al. | |
| 2006/0058483 | A1 | 3/2006 | Zha et al. | |
| 2006/0071063 | A1 | 4/2006 | Duckett | |
| 2006/0071796 | A1 | 4/2006 | Korzeniewski et al. | |
| 2006/0109496 | A1 | 5/2006 | Brown et al. | |
| 2006/0176152 | A1 | 8/2006 | Wagner et al. | |
| 2006/0221363 | A1 | 10/2006 | Roth et al. | |
| 2007/0010213 | A1 | 1/2007 | Dewan | |
| 2007/0013520 | A1 | 1/2007 | Conwell et al. | |
| 2007/0014615 | A1 | 1/2007 | Kasayama | |
| 2007/0023516 | A1 | 2/2007 | Chapman et al. | |
| 2007/0127965 | A1 | 6/2007 | Pagan et al. | |
| 2008/0074266 | A1 | 3/2008 | Ohashi et al. | |
| 2008/0074269 | A1 | 3/2008 | Torchalski et al. | |
| 2008/0186177 | A1 | 8/2008 | Nikitin et al. | |
| 2008/0223233 | A1 * | 9/2008 | Barboza | B41F 35/005 101/118 |
| 2009/0031553 | A1 | 2/2009 | Moriyama et al. | |
| 2009/0194588 | A1 | 8/2009 | Blanchard, Jr. et al. | |
| 2009/0307529 | A1 | 12/2009 | Kim | |
| 2010/0070305 | A1 | 3/2010 | Eisenberg et al. | |
| 2010/0102935 | A1 | 4/2010 | Chaves et al. | |
| 2010/0103238 | A1 | 4/2010 | Neuhard et al. | |
| 2010/0182390 | A1 | 7/2010 | Imaizumi | |
| 2010/0309275 | A1 * | 12/2010 | Kokuta | B41J 2/32 347/197 |
| 2010/0319561 | A1 * | 12/2010 | Colquitt | B41J 2/325 101/477 |
| 2011/0007665 | A1 | 1/2011 | Dinur | |
| 2012/0200654 | A1 | 8/2012 | Arrington et al. | |
| 2013/0063253 | A1 | 3/2013 | Rashid et al. | |
| 2013/0161382 | A1 | 6/2013 | Bauer et al. | |

FOREIGN PATENT DOCUMENTS

| | | |
|---|---|---|
| JP | S6113028 | 1/1986 |
| JP | 2003/200601 | 7/2003 |
| JP | 1491367 | 3/2014 |

OTHER PUBLICATIONS

International Search Report and Written Opinion dated Jan. 4, 2016 for IA No. PCT/US2015/055402.
International Preliminary Report on Patentability Chapter I dated Jan. 19, 2017 prepared for IA No. PCT/US15/55404.
International Preliminary Report on Patentability Chapter II dated Jan. 13, 2017 prepared for IA No. PCT/US2015/055402.
International Preliminary Report on Patentability Chapter I dated Apr. 18, 2017 prepared for IA No. PCT/US2015/055406.
International Search Report and Written Opinion dated Nov. 11, 2016, issued in corresponding International Application No. PCT/US2016/034215.
International Search Report and Written Opinion dated Jan. 4, 2016, issued in corresponding International Application No. PCT/US2015/055406.

* cited by examiner

THERMAL PRINTER AND COMPONENTS

CROSS REFERENCE TO RELATED APPLICATION(S)

The present application claims priority from U.S. Provisional Application No. 62/168,446 filed May 29, 2015, which is incorporated by herein by reference in their entirety.

BACKGROUND

The present invention relates generally to an improved printer and its components. More particularly, the present disclosure relates to an improved printer that comprises a plurality of components that provide a user with a simple, intuitive user-friendly touchscreen interface, is easy to assemble, and has a low cost to repair.

A barcode printer is a computer peripheral for printing barcode labels or tags that can be attached to, or printed directly on, physical objects. Barcode printers are commonly used to label cartons before shipment, or to label retail items with UPCs or EANs. The most common barcode printers employ one of two different printing technologies. Direct thermal printers use a print head to generate heat that causes a chemical reaction in specially designed paper that turns the paper black. Thermal transfer printers also use heat, but instead of the paper reacting, the heat melts a waxy or resinous substance on a ribbon that runs over the label or tag material. The heat transfers ink (the melted material) from the ribbon to the paper.

Barcode printers are designed for specific market segments. Industrial barcode printers are used in large warehouses, manufacturing facilities, and food facilities. They have large paper capacities, operate faster and have a longer service life. However, installation and configuration of industrial barcode printers can be difficult and non-customizable. For retail and office environments, desktop barcode printers are most common. These desktop barcode printers can also be difficult to install and configure to which a touch screen user interface could make the user configuration simpler.

Furthermore, thermal barcode printers have parts that comprise the print mechanism of the device, including gears, print head, platen roller, clips, bearings, etc. Some of these components, such as the platen roller, come in direct contact with the paper and are subject to wear and tear over the life of the component. Further, accessing and changing these parts can be difficult requiring downtime of the equipment. For example, changing a print head requires insertion of a 25 pin ribbon cable which can be difficult and cumbersome to users. Thus, there exists a need for a method of changing a platen roller quickly and with no special tools, as well as a need for a method of mechanically guiding the print head into the carrier to make the electrical connection eliminating the need for the user to fumble with a cable.

Additionally, barcode printers accommodate different sizes of supplies, and are able to accept only one type of core. Thus, there exists a need for a universal supply holder to accommodate different sizes of inner diameter cores for tag and laminated supplies, as well as a method of allowing a user to easily change from cardboard to plastic cores for the ink supply on the same printer. Print quality when using thermal transfer supplies depends on the ribbon drive control of the ribbon spool in both the forward and reverse directions.

Further, barcode printers comprise multiple sensors for aligning and printing labels, as well as other various printer supply operations, including informing a user when the printer is out of stock. Thus, there exists a need for a sensor that minimizes the user setup needed for printing on a continuous roll of labels, and a sensor for providing a low supply indicator to give adequate time to prepare for the out of stock condition to minimize downtime for the printer.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an improved printer that comprises a plurality of components that provide a user with a simple, intuitive user-friendly touchscreen interface, is easy to assemble, and has a low cost to repair. Specifically, the printer comprises a platen roller that can be changed without tools via the use of a bayonet connector. The printer also discloses an easy change print head that mechanically guides the print head into the carrier to make the electrical connection, eliminating the need for the user to fumble with a cable. Specifically, the print head is guided into the correct location via mechanical guiding pins that give positive feedback by being keyed with the correct location of the print head.

Further, the printer discloses a universal supply holder to accommodate different sizes of inner diameter cores for tag and laminated supplies. The universal supply holder comprises a pair of aluminum plates that are positioned on the supply holder arm at different heights depending on the size of supply cores being used on the printer. The printer also discloses a ribbon spindle that accommodates both a cardboard core and a plastic core on the same printer device.

Additionally, the printer discloses a media low sensor for providing a low supply indicator to give adequate time to prepare for the out of stock condition to minimize downtime for the printer. The media low sensor can either be a time of flight sensor or a reflective sensor. The printer also discloses a gap sensor that minimizes the user setup needed for printing on a continuous roll of labels. The gap sensor comprises an LED array and a resistor array for gap sensing across the supply web.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
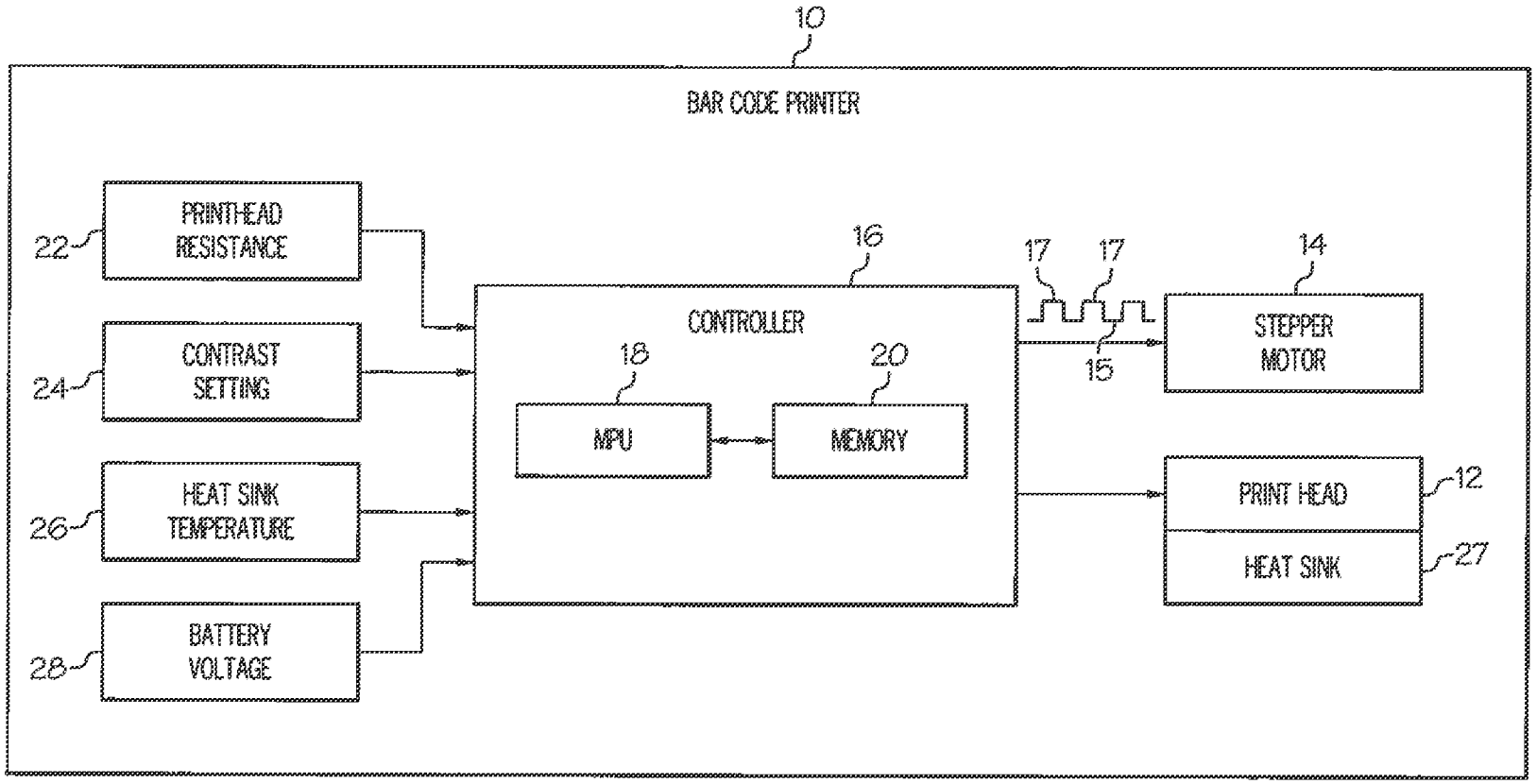
FIG. 1 illustrates a block diagram of a bar code printer in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses an improved printer that comprises a plurality of components that provide a user with a simple, intuitive user-friendly touchscreen interface. The presently disclosed printer is also easy to assemble, and has a low cost to repair. Specifically, the printer comprises a platen roller that can be changed without tools via the use of a bayonet connector. The printer also comprises an easy change print head that mechanically guides the print head into the carrier via mechanical guiding pins to make the electrical connection. Further, the printer comprises a universal supply holder to accommodate different sizes of inner diameter cores for tag and laminated supplies. The printer also comprises a ribbon spindle that accommodates both a cardboard core and a plastic core on the same printer device. Additionally, the printer may comprise a media low sensor for providing a low supply indicator to give adequate time to prepare for the out of stock condition to minimize downtime for the printer. Finally, the printer comprises a gap sensor that comprises an LED array and a resistor array for gap sensing across the supply web.

Referring initially to the drawings, FIG. 1 illustrates a printer 10 in accordance with the present invention. The printer 10 of the present invention, in one embodiment, may be a bar code printer. The printer 10 comprises a thermal print head 12 for printing barcodes and alphanumeric information on a web of record members such as tags, labels or the like. The supply of the web of record members may be of the direct printing type such that the record members include paper coated with a thermally responsive material. Alternatively, the supply used with the printer 10 may be of the transfer type wherein a carbon ribbon is heat activated by the print head 12 so as to print on the record members. The print head 12 is strobed to control the amount of energy applied thereto for printing. More particularly, current is applied to the print head 12 during a strobe time in order to print one line on a record member.

The bar code printer 10 also includes a stepper motor 14 or the like that is responsive to a periodic drive signal 15, the period 17 of which is defined by the time between the leading edges of consecutive or adjacent pulses of the drive signal. The stepper motor 14 is responsive to the drive signal 15 to advance the web of record members past the print head 12 for printing. The drive signal 15 controls the speed of the stepper motor 14 which in turn controls the print speed of the bar code printer 10.

A controller 16 includes a microprocessor 18 or the like which operates in accordance with software routines stored in a memory 20 so as to control the operations of the bar code printer 10. A number of sensors, monitors, detectors or the like such as depicted at 22, 24, 26, and 28, monitor operating conditions of the bar code printer 10 including the resistance of the print head 12, the contrast setting of the barcode printer, the temperature of a heat sink 27 on which the print head 12 is mounted and the voltage of a battery powering the bar code printer 10. The measured values of the print head resistance, contrast setting, heat sink temperature, battery voltage, as well as other operating variables if desired, are utilized by the microprocessor 18 when implementing print speed control.

Additionally, the print mechanism of thermal printers include many different types of parts. Such parts include for example, gears, print head, platen roller, clips, bearings, etc. Some of these components come in direct contact with the paper used in the printer and are subject to wear over the life of the printer. Accessing and changing these components can be difficult requiring downtime of the equipment. Therefore, it is desirable to be able to change the platen roller efficiently and quickly with limited or no tools.

In order to create a platen roller that can be changed without tools, a bayonet connector may be employed. A bayonet connector is a fastening mechanism comprising a cylindrical male side with one radial pin and a female receptor with a matched L-shaped slot with springs to keep the two parts locked together.

Figure 2:
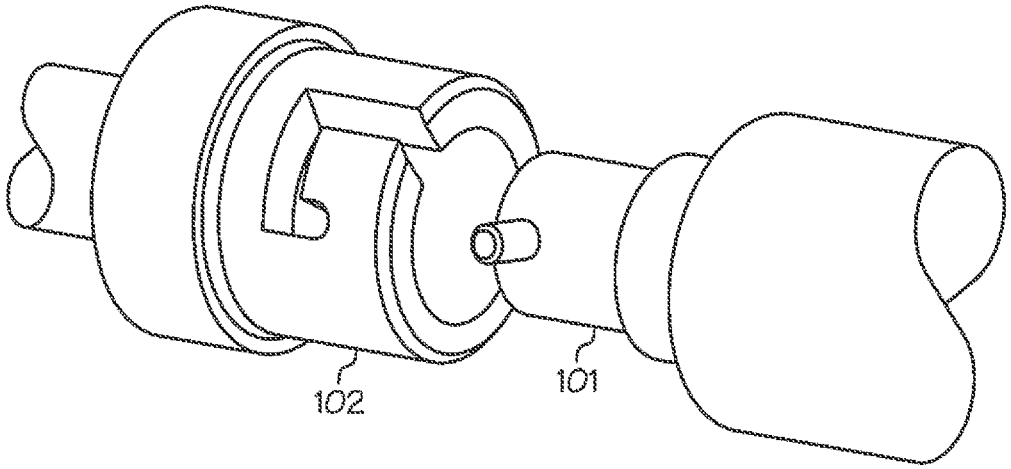
FIG. 2 illustrates a perspective view of a platen roller fitted into a bayonet coupling system for a bar code printer in accordance with the disclosed architecture.
Figure 3:
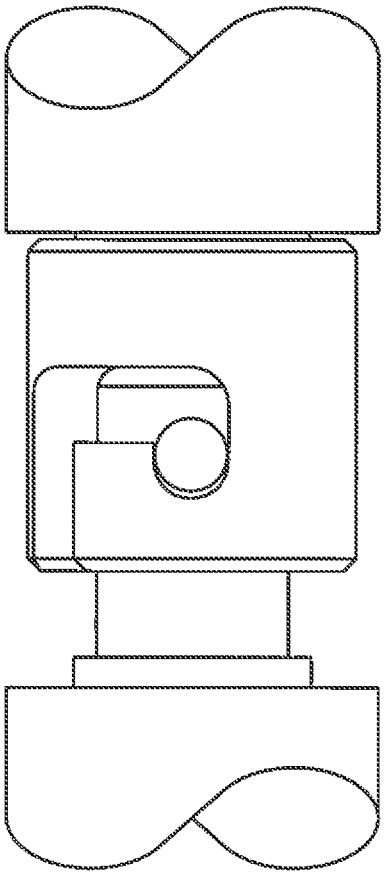
FIG. 3 illustrates a perspective view of a positive connection of the platen roller to the printer main frame of a bar code printer in accordance with the disclosed architecture.
Figure 4:
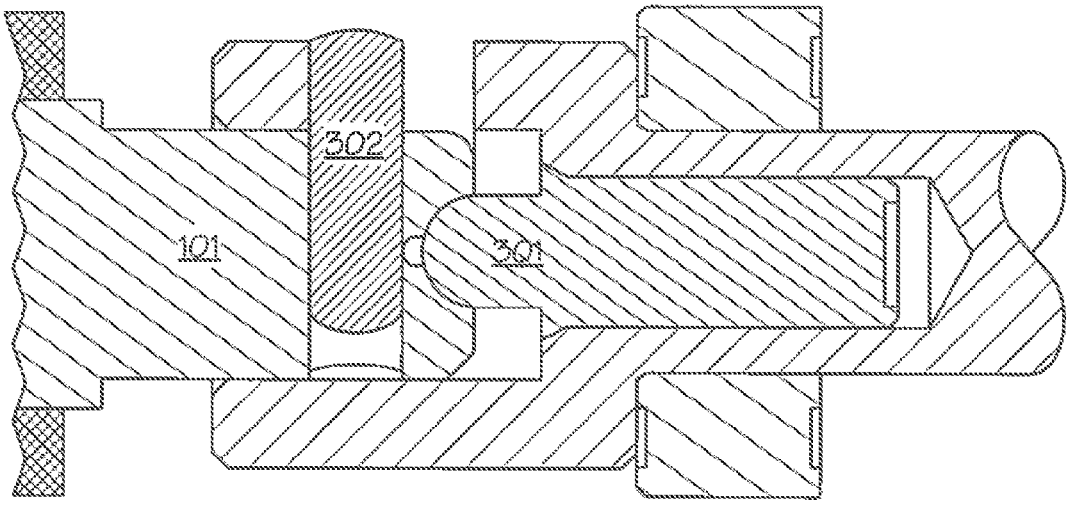
FIG. 4 illustrates a cross-sectional view of the coupling system of the bar code printer in accordance with the disclosed architecture.

Referring initially to the drawings, FIG. 2 illustrates a platen roller 101 properly aligned with the dent positioned so that it will line up with the L-shaped slot 102. The receptacle that contains the L-shaped slot 102 is part of the frame of the printer. In the preferred embodiment, on the opposing side of the printer frame would be a matching bayonet receptacle. The present invention contemplates that the slot of the receptacle can be various types of geometric configurations. For instance, in another embodiment, there could be a U-shaped channel to hold the roller with a horizontal spring to create the necessary force to hold the roller in place. In FIG. 4 reference number 301 shows a vertical spring that aligns the platen shaft 101 along the outer wall of the connector. Vertical spring 302 depresses for insertion into a slot that may be L-shaped and then is pushed upwards into the slot by the spring. The connector is no longer free to rotate unless pressure is depressed against the vertical spring 302 to release it from the slot. FIG. 3 depicts a connection system once the platen shaft 101 is correctly inserted into the receptacle 102.

Additionally, tag and laminated supplies may be made on different size inner diameter cores (ID) such as 4", 3", or 1" for a variety of reasons. Thus, it is desirable to have a universal supply holder in a printer for a user to easily be able to run supplies using different core IDs. Traditional supply holders are designed with a bar approach to accommodate the different ID sizes. The user could simply place their supply core on the supply bar to accommodate the different sizes. However, when a supply is running in an on-demand or short-run manner on a printer. the printer may start and stop frequently. When the printer starts and stops it may cause a rocking motion in the web. This rocking motion can cause a disturbance at the print point of the printer, because of the backward motion on the supply. If the supply holder is adaptable to closer meet the ID size, this motion would be minimized. The subject of the invention provides for a universal supply holder to accommodate different ID sizes.

Figure 5:
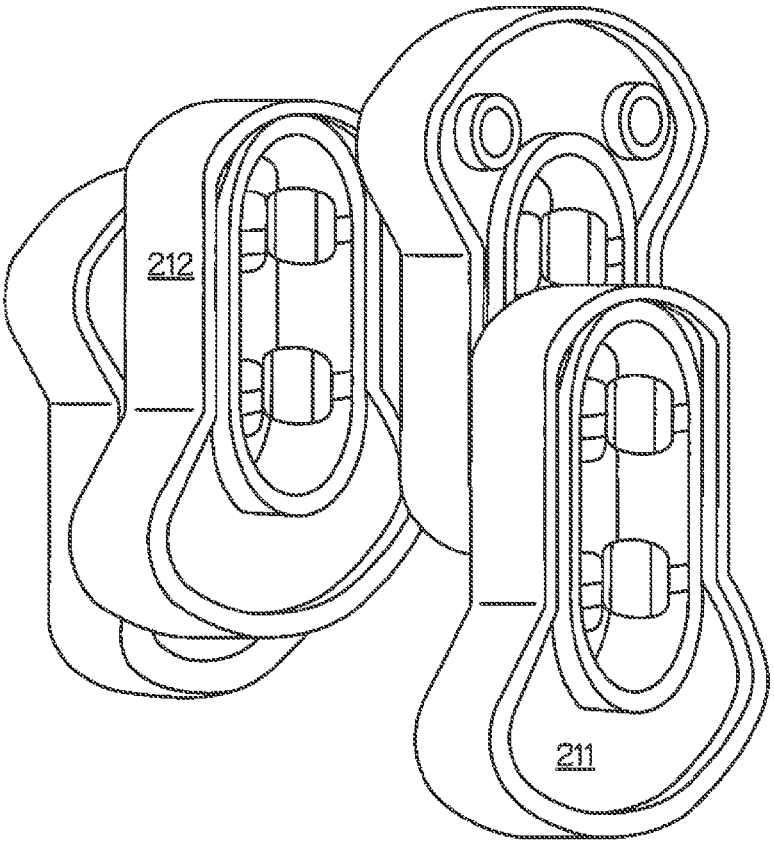
FIG. 5 illustrates a perspective view of the supply core adaptive guide in both the 4" and 3" core size positions for a bar code printer in accordance with the disclosed architecture.
Figure 6:
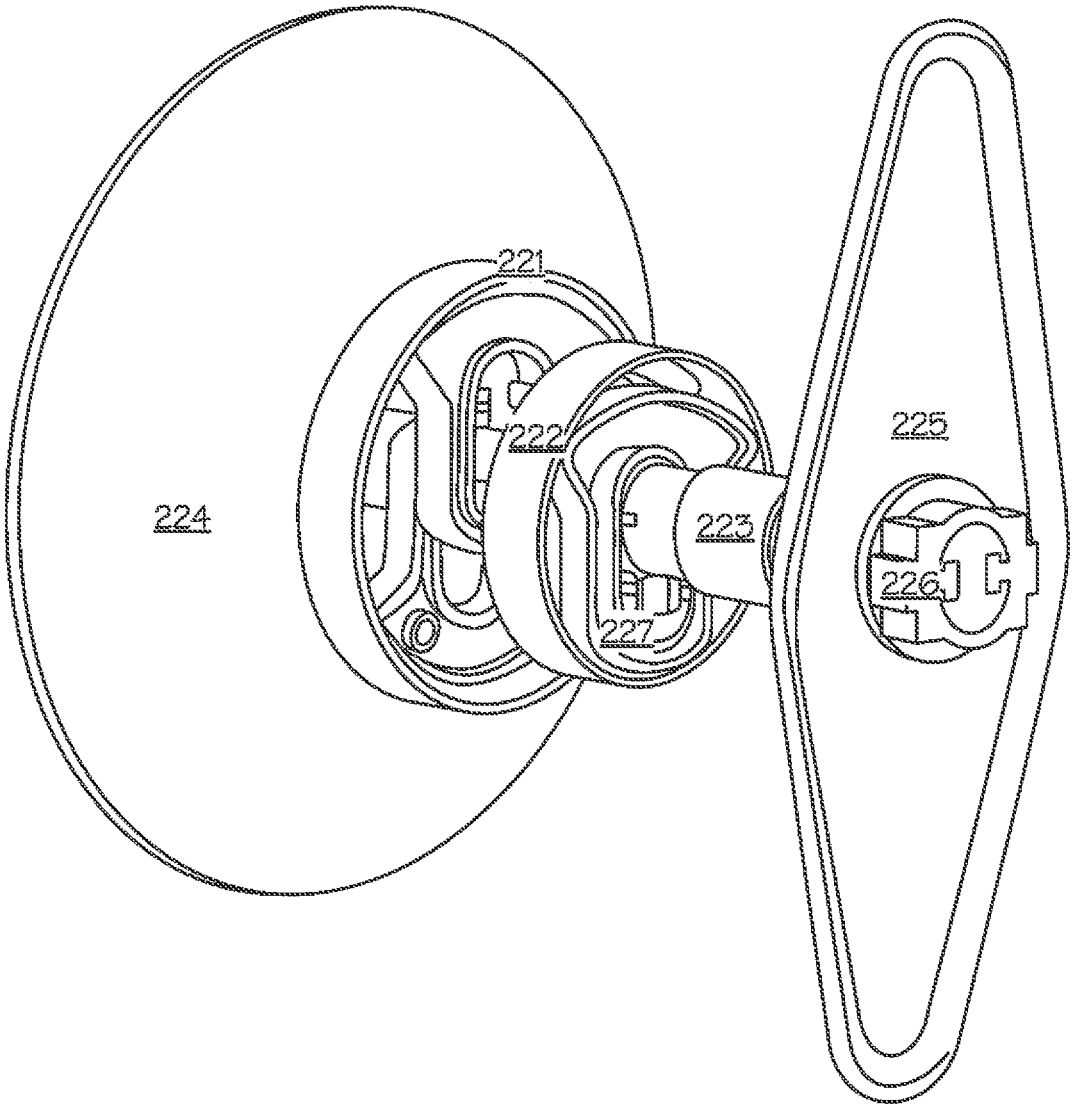
FIG. 6 illustrates a perspective view of the supply holder assembly depicting the 4", 3", and 1" core positions for a bar code printer in accordance with the disclosed architecture.

FIG. 5 illustrates a preferred embodiment of a supply core adaptor which will fit on the supply holder shaft in the supply holder assembly depicted in FIG. 6. FIG. 5 depicts a part that preferably is made out of aluminum, but may be constructed from any type of material. The part comprises two identical components, such as plates, positioned together, wherein the position of the plates is dependent on the size of supply cores being used. For example, in FIG. 5, reference number 212 depicts the supply core adaptor in the lowered position where the two plates meet in height. This position would be suitable for a supply core, such as a 3" core, to support the supply roll while minimizing the rocking motion of the supply roll. Reference number 211 depicts the supply core adaptor in a raised position. This position would be suitable for 4" supply cores.

In FIG. 6, a complete supply holder assembly is shown where the 1" (223), 3" (222), and the 4" (221) cores are shown with the supply core adaptor for the 3" and 4". This is for illustration purposes only, in an actual configuration the printer would only have one core installed at a time. Reference number 224 is the inner supply holder plate and reference number 225 is the outer supply holder plate. Reference number 226 is the retaining clip which holds the supply holder plate 225 in the proper position. Reference number 227 is the main element of the supply holder assembly, and is the horizontal carrier, or supply holder arm, with detents formed into the sides in order to accept the supply core adaptor. The supply holder arm is designed to accept the 1" supply core with no adaptor required as shown in 223. If the user wishes to install a supply roll with a 3" core the user simply slides the supply core adaptor in the down position onto the main element of the supply holder 227 using the detents as guides (i.e., in the lowered position where the two plates meet in height). The user can then load a supply roll with a 3" core as depicted in 222. The same process is used if the user wishes to load a supply roll with a 4" core. The user slides the supply core adaptor onto the main element of the supply 227 as shown in 221 (i.e., in a raised position, where the two plates are spaced apart from each other).

Additionally, when a ribbon spool is installed on a ribbon spindle it is necessary to securely retain the core of the ribbon spool for purposes of print quality and take-up of spent ribbon. In the product line, there are two types of inner cores for the ribbons (or ink), cardboard which is commonly available and plastic which is only available through Avery Dennison Retail Branding Information Services, LLC of Westborough, Mass. Today printers are built to accept only cardboard or plastic cores, not both. If a user has an Avery printer which is built to accept only plastic cores, and they have ribbon on cardboard cores their only option is to get another printer, or get ribbons on plastic cores. This invention will enable a customer to easily change from running cardboard to plastic cores or vice versa on the same printer.

Figure 7:
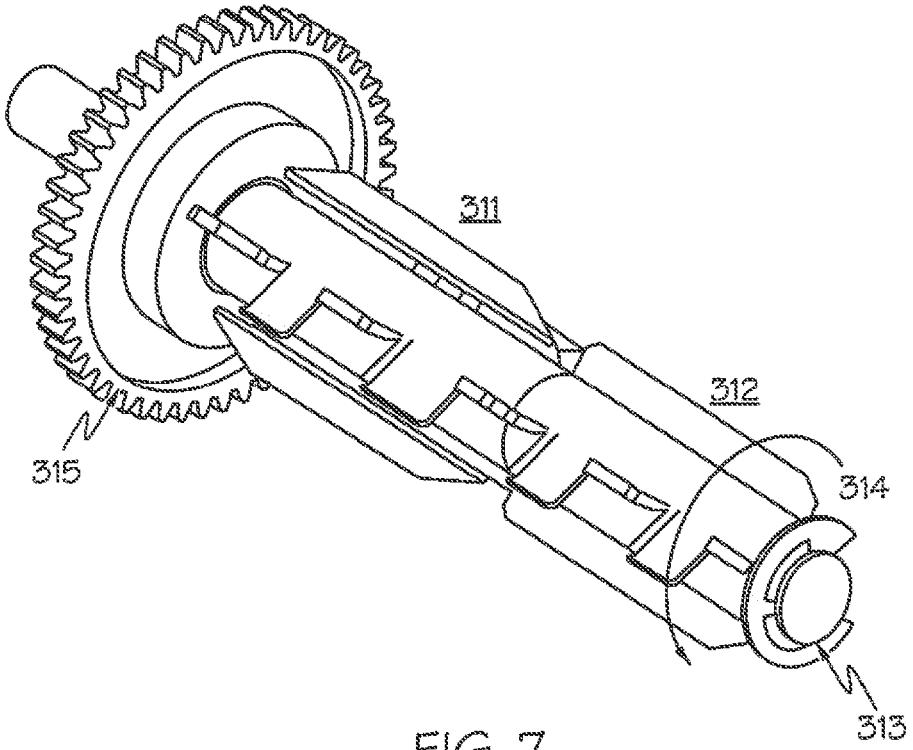
FIG. 7 illustrates a perspective view of the ribbon spindle for a bar code printer in accordance with the disclosed architecture.
Figure 8:
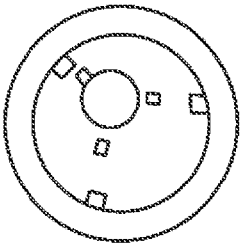
FIG. 8 illustrates a perspective view of the plastic core for ribbon in accordance with the disclosed architecture.
Figure 9:
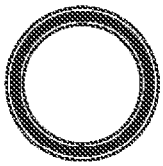
FIG. 9 illustrates a perspective view of the cardboard core for ribbon in accordance with the disclosed architecture.

Referring to FIG. 7, FIG. 7 illustrates a ribbon spindle that can accommodate both a plastic core (see FIG. 8) or a cardboard core (see FIG. 9), as the ribbon spindle contains interchangeable retaining features for both cores. Specifically, the retaining features for the plastic core are features, inserted into slots on the ribbon shaft, that interlock with the plastic core when it is slid onto the shaft, shown as reference number 312 in FIG. 7. Further, the retaining features for the cardboard cores are metal retaining pins 311 that grab the sides of the cardboard core which is lacking in mechanical features. The pins, when inserted into slots on the ribbon spindle, are then used to mount the cardboard core and securely retain it to the ribbon spindle illustrated in FIG. 7. Thus, to make it easy to switch from a plastic core (FIG. 8) to a cardboard core (FIG. 9) in a single printer, both retention mechanisms are interchanged by the user on a single ribbon spindle. Accordingly, reference number 312 is the plastic core (FIG. 8) mating retention feature, and reference number 311 is the cardboard core (FIG. 9) retaining pin, as shown in FIG. 7. Further, 315 in FIG. 7, is the main gear connecting to the electric motor drive system. Reference number 313 of FIG. 7 is the ribbon core shaft where either ribbon core shown in FIG. 8 or 9 may be s mounted when installing a ribbon core into the system. Thus, both core types (FIGS. 8 and 9) are present and available at all times.

Figure 10:
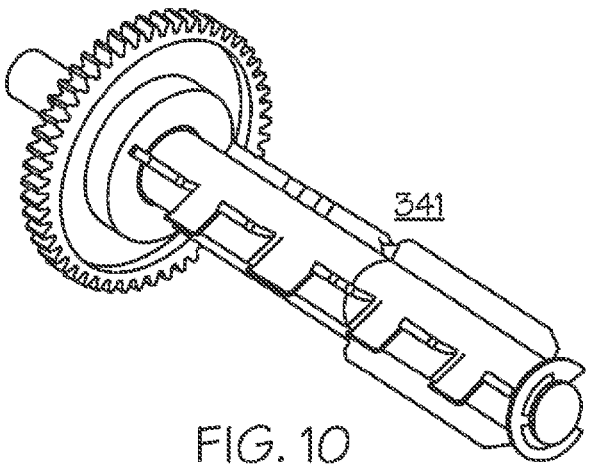
FIG. 10 illustrates a perspective view of the ribbon spindle with the cardboard core features retracted in accordance with the disclosed architecture.

In another embodiment of the present invention, a retraction method can be employed. For example, for an effective ribbon supply core retention of the core of FIG. 9 (cardboard core), the retention features for the ribbon core shown in FIG. 8 (plastic core) are not obstructive. Thus, for retention of the cardboard cores, the ribbon spindle assembly will look like the ribbon spindle assembly illustrated in FIG. 7, then when a user wants to change the ribbon retention features from a cardboard core to a plastic core, a user would rotate the end 314 (retraction component) of the ribbon spindle in a counterclockwise direction, which retracts the retention features 311 for the cardboard core as indicated by reference number 341 in FIG. 10, and allows unobstructed retention of the plastic cores.

Additionally, typical quick-change print heads for printers require a user to depress two tabs to release the print head to change it, the user is then required to remove and re-insert a 25 pin ribbon cable back into the print head in order for electrical contact to occur. However, the inserting of the 25 pin ribbon cable is difficult and cumbersome to users. Thus, an improved method of changing the print head is disclosed, wherein the print head is mechanically guided into the carrier to make the electrical connection, eliminating the need for the user to fumble with a cable.

Figure 11:
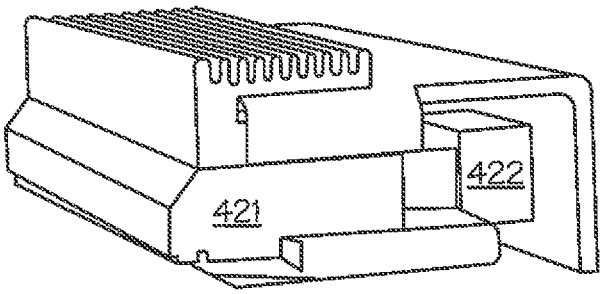
FIG. 11 illustrates a perspective view of an easy change print head in accordance with the disclosed architecture.
Figure 13:
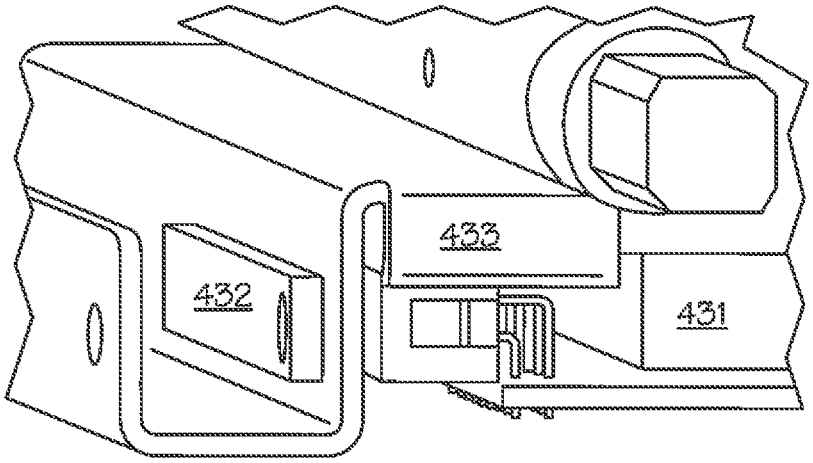
FIG. 13 illustrates a perspective view of the reverse side of the easy change print head in accordance with the disclosed architecture.

As shown in FIG. 11, the print head 421 is inserted into the easy connector component 422. Then, FIG. 13 depicts the print head 421 inserted into the easy connector component 422 from the reverse side. This use of the easy connector component 422 is an improvement over the typical method and utilization of printers presently available which require a user to insert the 25 pin ribbon cable into the print head 421.

Figure 12:
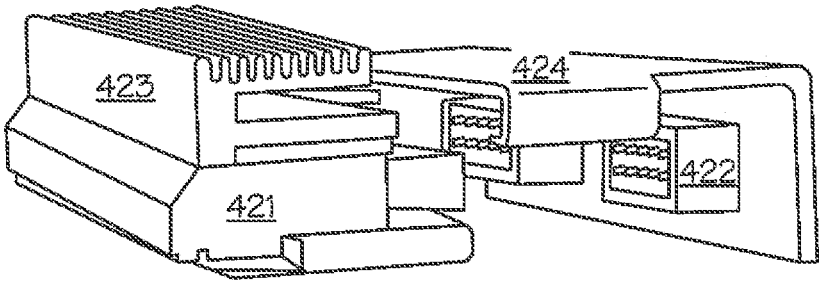
FIG. 12 illustrates a perspective view of a print head being guided into connection in accordance with the disclosed architecture.
Figure 14:
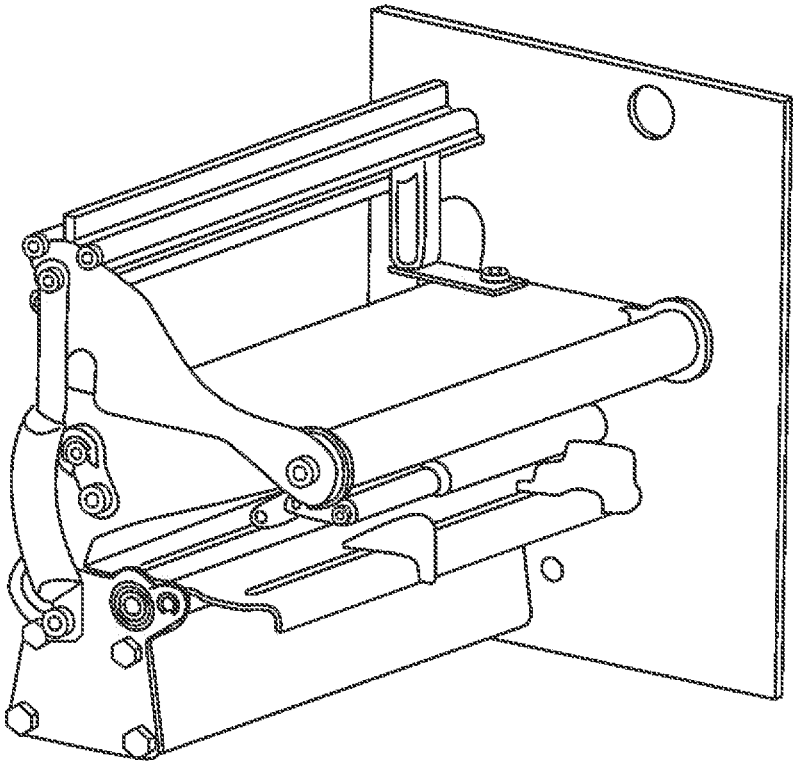
FIG. 14 illustrates a perspective view of the print mechanism closed in accordance with the disclosed architecture.
Figure 15:
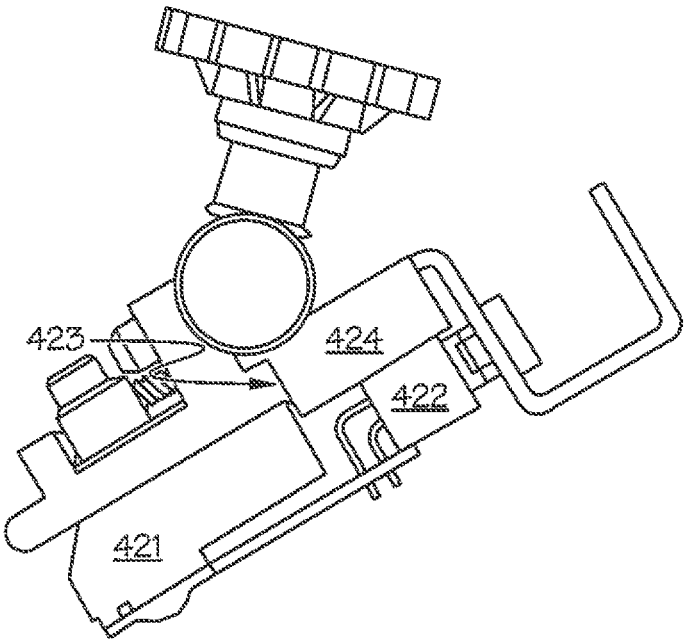
FIG. 15 illustrates a perspective view of the print mechanism closed in accordance with the disclosed architecture.
Figure 16:
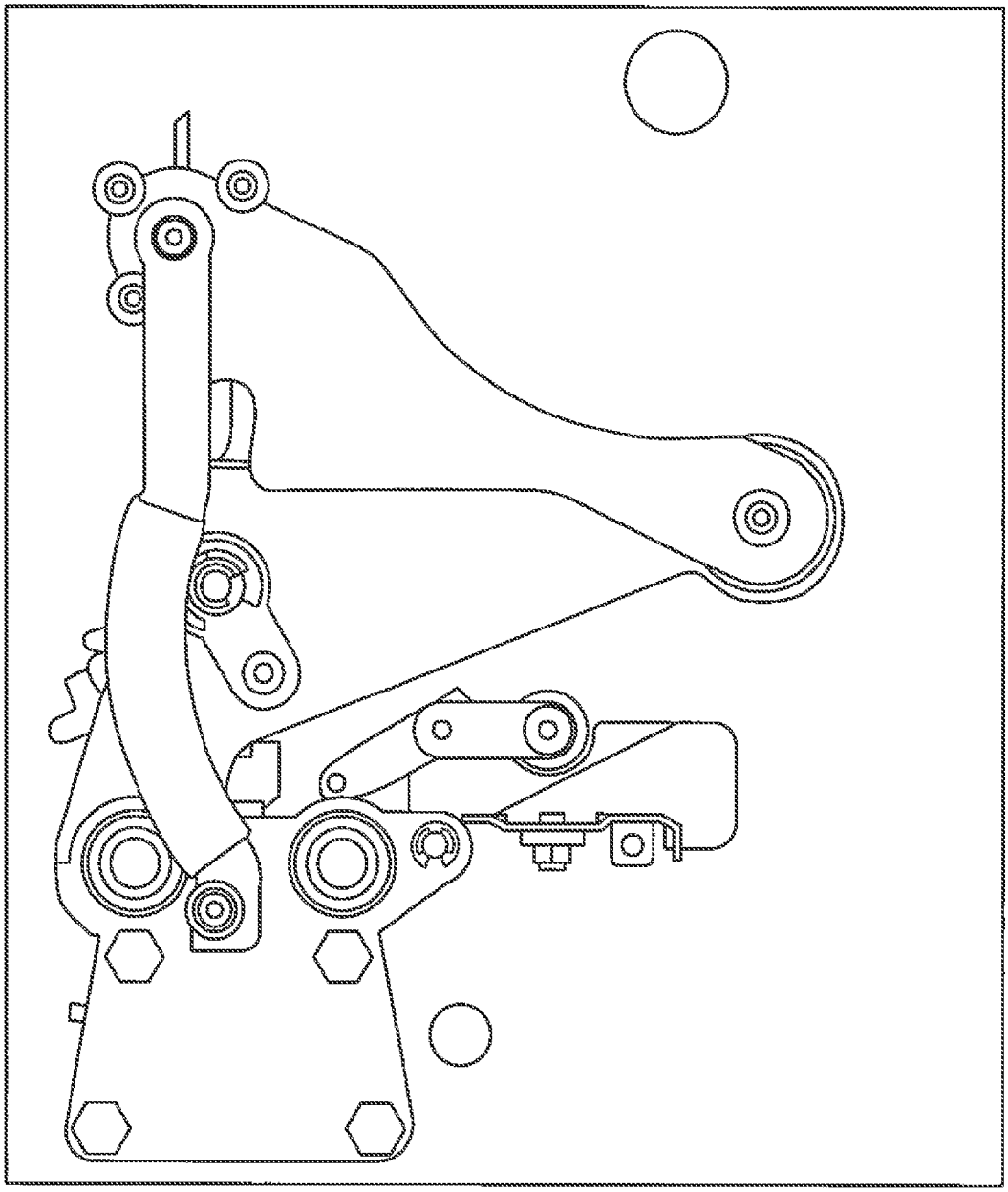
FIG. 16 illustrates a perspective view of the print mechanism closed in accordance with the disclosed architecture.
Figure 41:
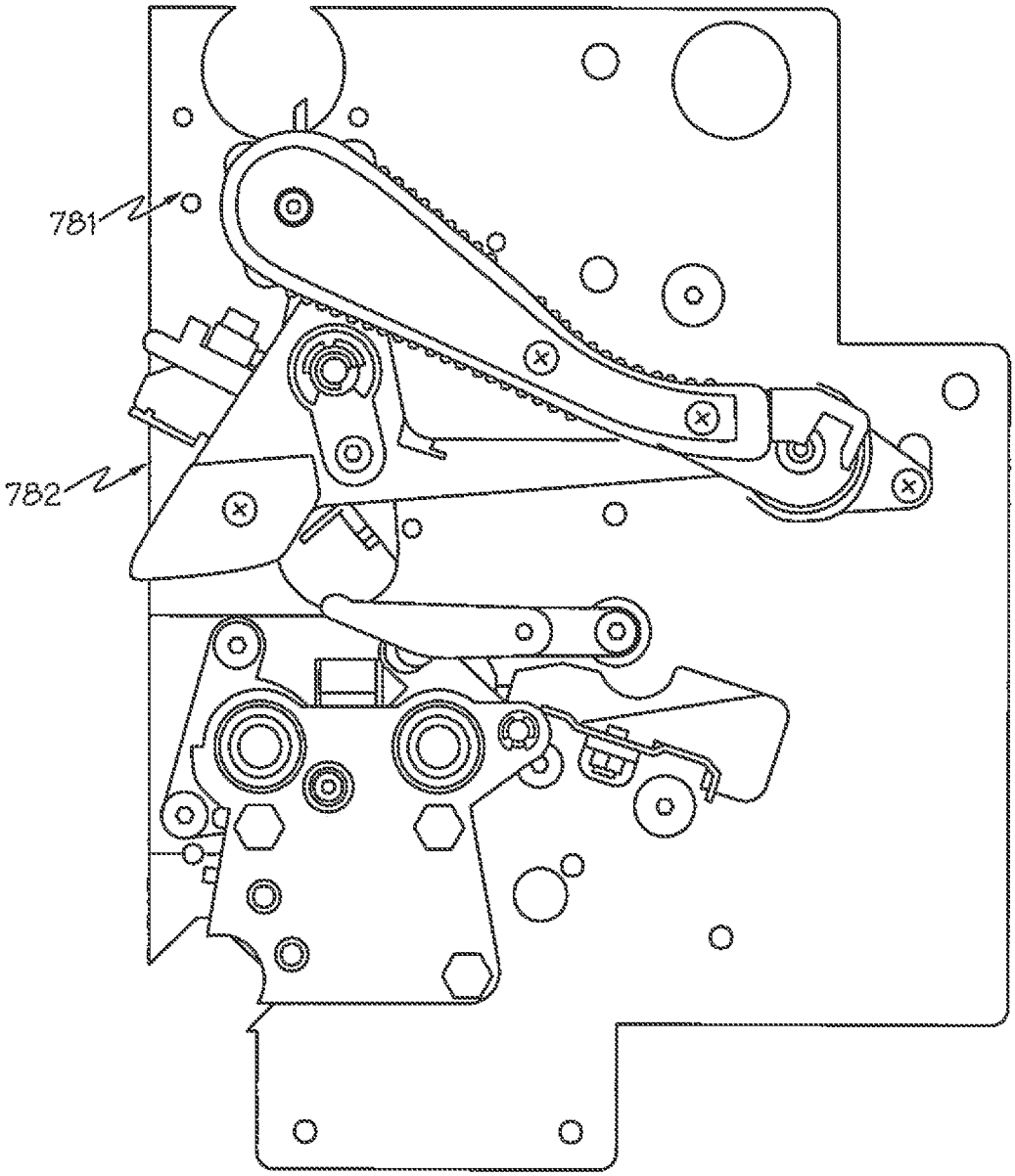
FIG. 41 illustrates a perspective view of the print mechanism open in accordance with the disclosed architecture.

Further, in FIG. 12 the print head 421 is guided into the correct location by the user with mechanical guiding pins 423. The female side of 423 give a positive feedback with the beveled side that is keyed to ensure that the user will insert the print head in the correct direction. Further, reference number 424 displays the side of 423 mechanical feature the on the easy connector component 433 to securely hold the print head 421 in place once the connection system is engaged. FIG. 15 illustrates another view of the print head 421 engaged in the easy connector component 422. The mechanical guiding pins 423 guide the print head 421 into place and are held by the connection system 424. Further, FIG. 14 illustrates the print head mechanism closed and FIG. 41 depicts the print head mechanism open.

Additionally, in order for labels from a continuous roll to move through a bar code printer, the printer mechanism relies on sensors that detect a gap, notch, slot, or line between labels delineating where the next label starts. The printer then uses this label start position to align print, knife cuts, and other various printer supply operations. This invention discloses a set of receptors and LEDs that create a bar that the supply would be fed through. This minimizes the user setup that would need to be done, such as moving the mark within the sensor's field of operation by creating a field of operation that spans the web of the printer.

Figure 25:
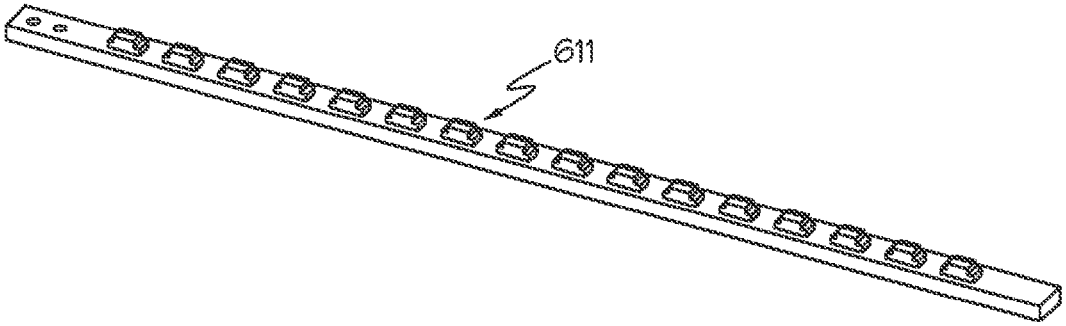
FIG. 25 illustrates a perspective view of an LED array for gap sensing across the web in accordance with the disclosed architecture.
Figure 26:
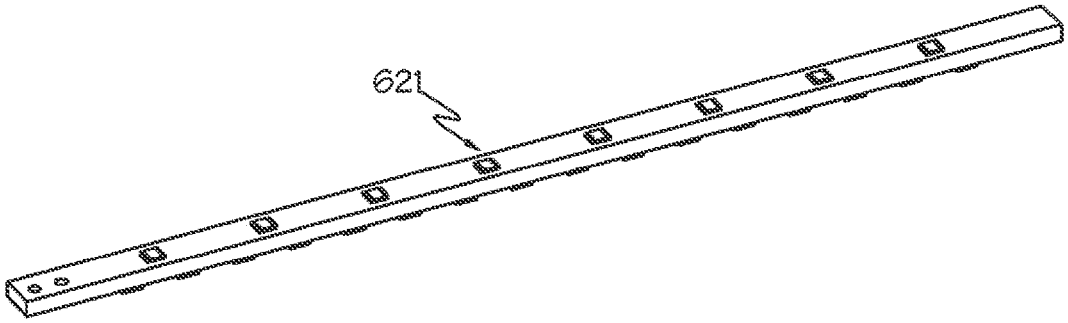
FIG. 26 illustrates a perspective view of a collector resistor array for gap sensing across the web in accordance with the disclosed architecture.
Figure 27:
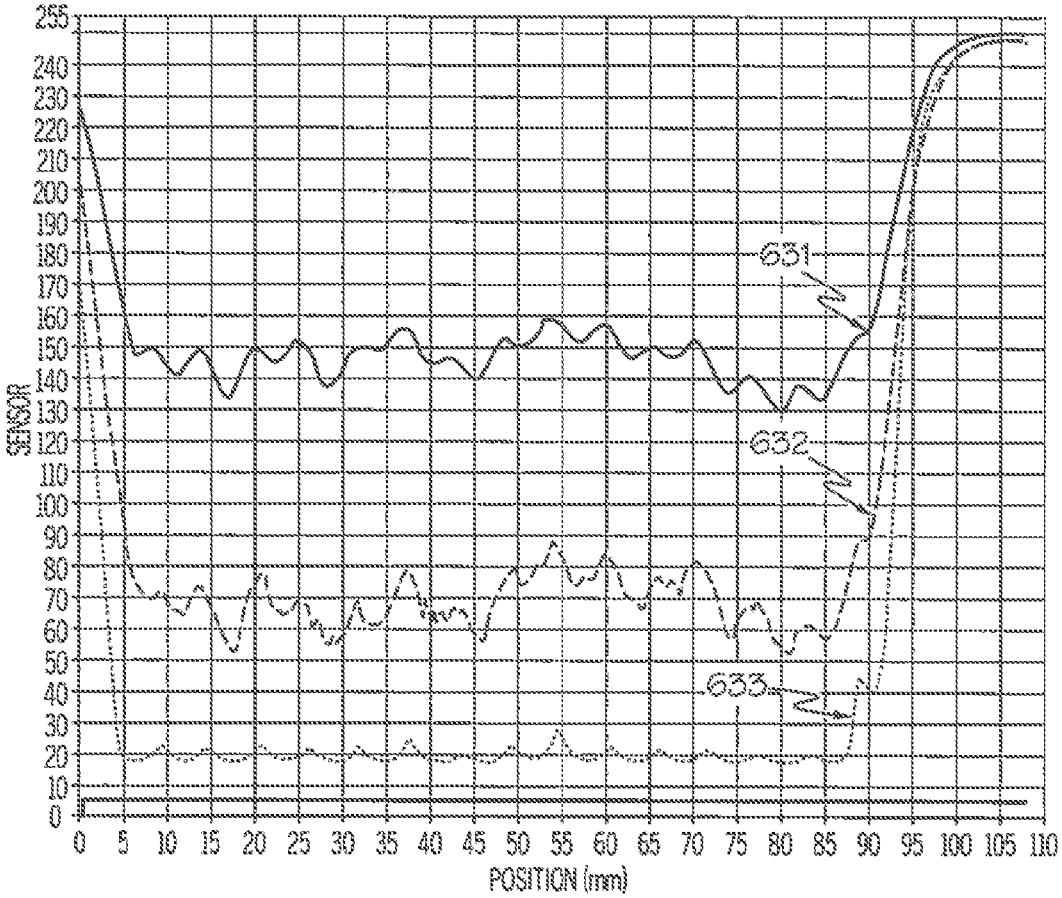
FIG. 27 illustrates a graph of the test results for supply, backing paper, and no material in accordance with the disclosed architecture.
Figure 28:
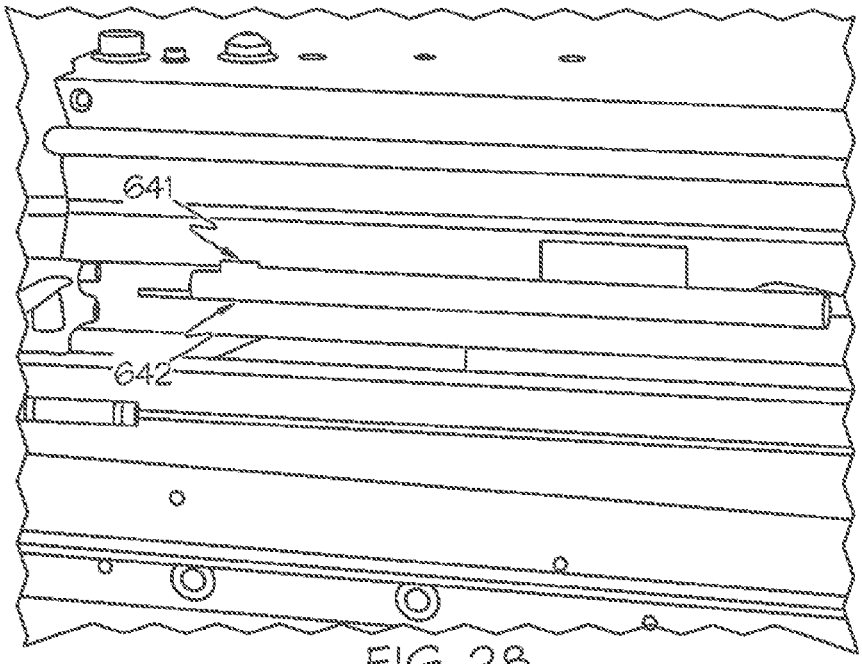
FIG. 28 illustrates a perspective view of a printer with both an LED array and a collector array in accordance with the disclosed architecture.
Figure 29:
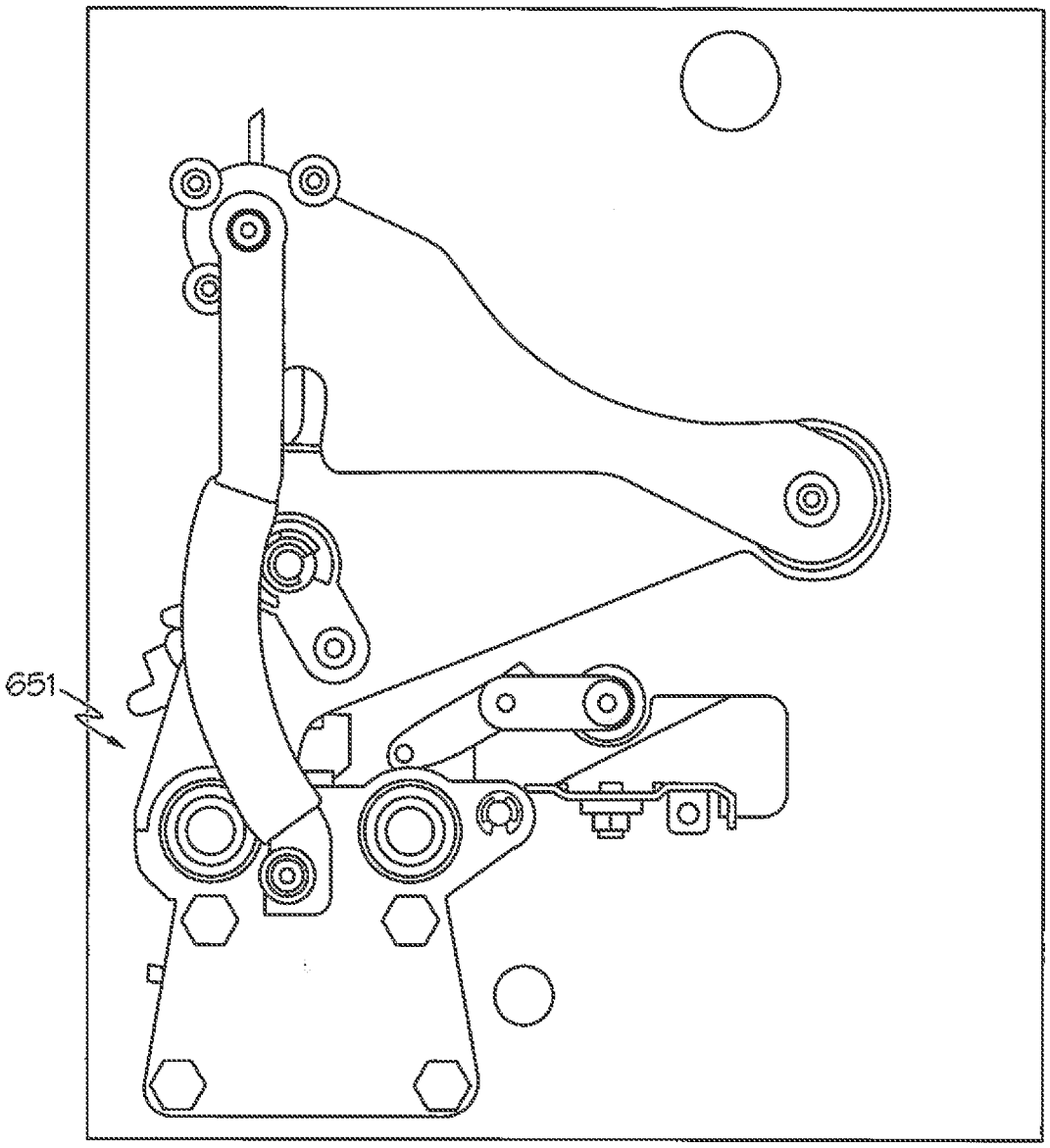
FIG. 29 illustrates side perspective view of a printer in accordance with the disclosed architecture.

An LED array is shown in FIG. 25, wherein reference number 611 shows a single LED. Further, FIG. 26 shows the receptacle array, reference number 621 on the resistor side. The LED array will be positioned over top of the supplies as shown in FIG. 28, see reference number 641, and the receptacle array will be positioned below, see reference number 642. FIG. 27 shows the test results using supply 631, backing paper 632, and no material 633. A cross-section of the printer with the LED array in location 651, is shown in FIG. 29.

Figure 32:
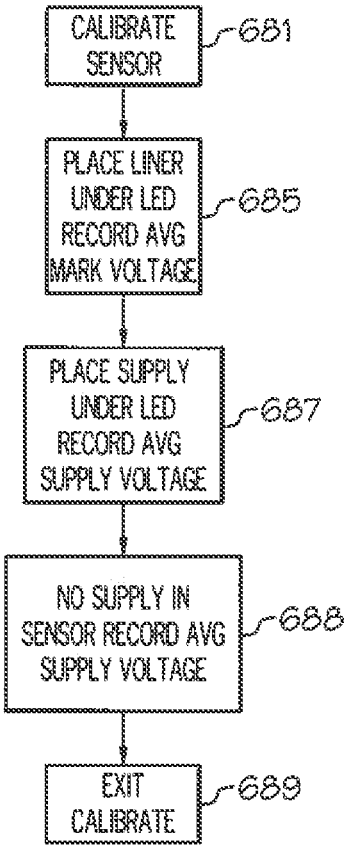
FIG. 32 illustrates a flowchart of sensor calibration in accordance with the disclosed architecture.

FIG. 32 discloses a flowchart of the method of calibrating the sensor. Specifically, the setup of the sensor, prior to running supplies through the printer, will require taking the following voltage levels: liner paper, supply (label or card stock), or no supply in the sensor. At step 681, the calibrate sensor logic is entered. At 685, the liner paper is placed under the LED, and the average mark voltage is recorded. At 687, the supply (label construction requires a baking paper, label stock, and adhesive sandwich) is placed under the LED, and the average supply voltage is recorded. At 688, no supply is placed in the sensor and the average supply voltage is recorded. Specifically, step 687 averages the voltage received when the stock is placed in the sensor and the last reading is step 688, which marks the voltage when there is no supply under the sensor. At 689, calibration is exited.

Figure 30:
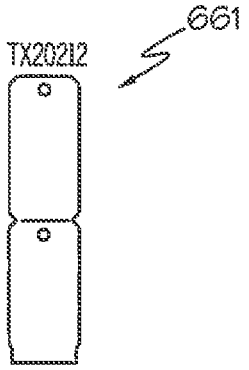
FIG. 30 illustrates a perspective view of a through-hole sense mark tag in accordance with the disclosed architecture.
Figure 33:
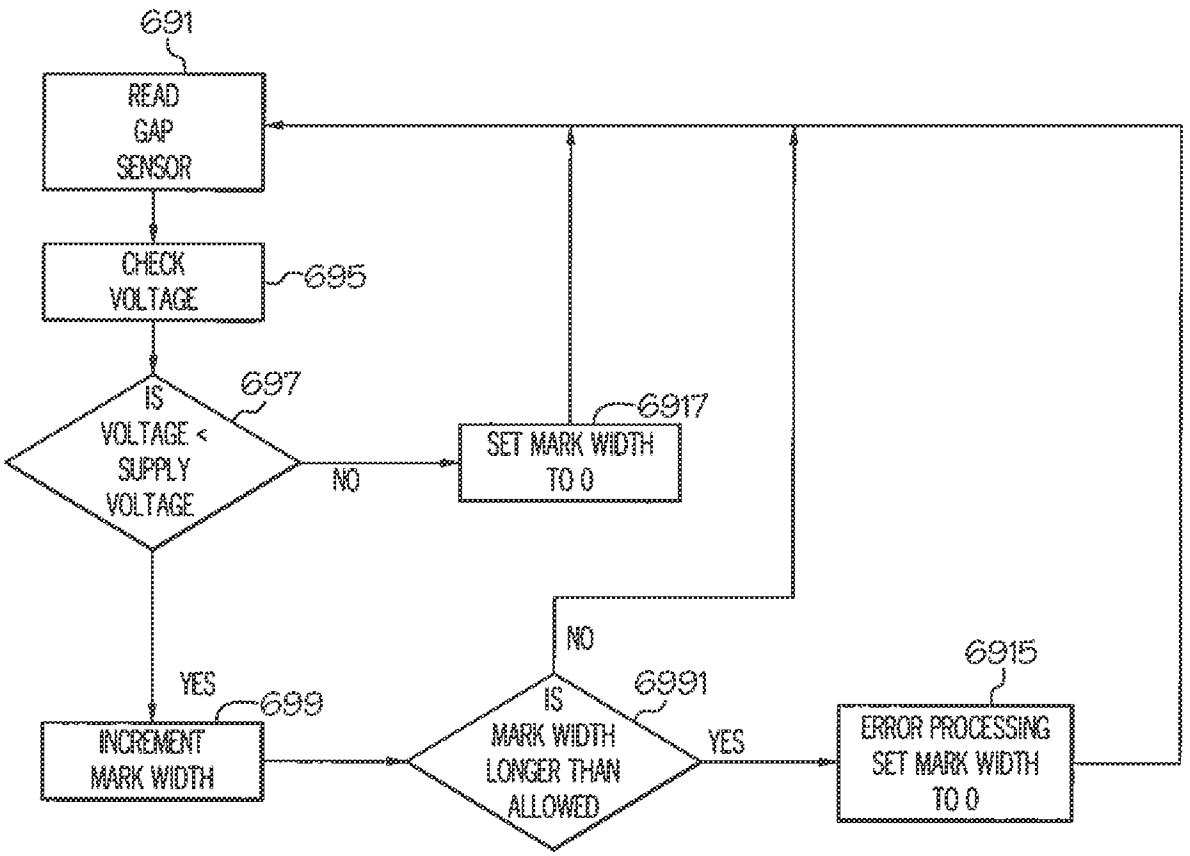
FIG. 33 illustrates a flowchart of through-hole sensing in accordance with the disclosed architecture.

The sensing algorithm is dependent upon the sense mark (gap, through-hole, aperture (side hole) on the supply that is installed in the printer. A through-hole supply example is shown in FIG. 30, see reference number 661. FIG. 33 discloses the through-hole flowchart. At 691, the method begins with the read gap sensor. At 695, the voltage is read from the sensor. If the voltage is more than the supply voltage reference value read in step 697, the logic proceeds to step 6917 which indicates that the printer is on supply and the mark width is set to 0, then the logic proceeds to the read gap sensor step at 691. If the voltage is less than the supply voltage reference value read in step 697, the logic proceeds to step 699 to set the increment mark width. At 6991, it is determined if the mark width is wider (or longer) than the allowed width. If yes, then error processing is performed at step 6915 to inform a user that an invalid mark was encountered. If no, then the logic returns to the read gap sensor step at 691.

Figure 31:
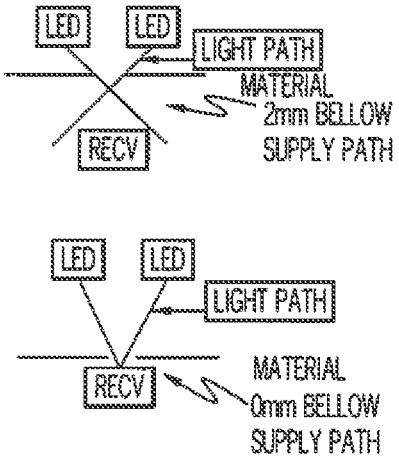
FIG. 31 illustrates a diagram of through-hole sensing at different distances in accordance with the disclosed architecture.

In FIG. 31, the results of testing wherein the receptacle array was placed in reference to the supply are displayed. Thus, with the supply placed 2 mm above the receptacle which is located under the supply opposite the led array which is positioned above the supply, the results were not as favorable as when the supply was placed 0 mm above the receptacle array.

Figure 34:
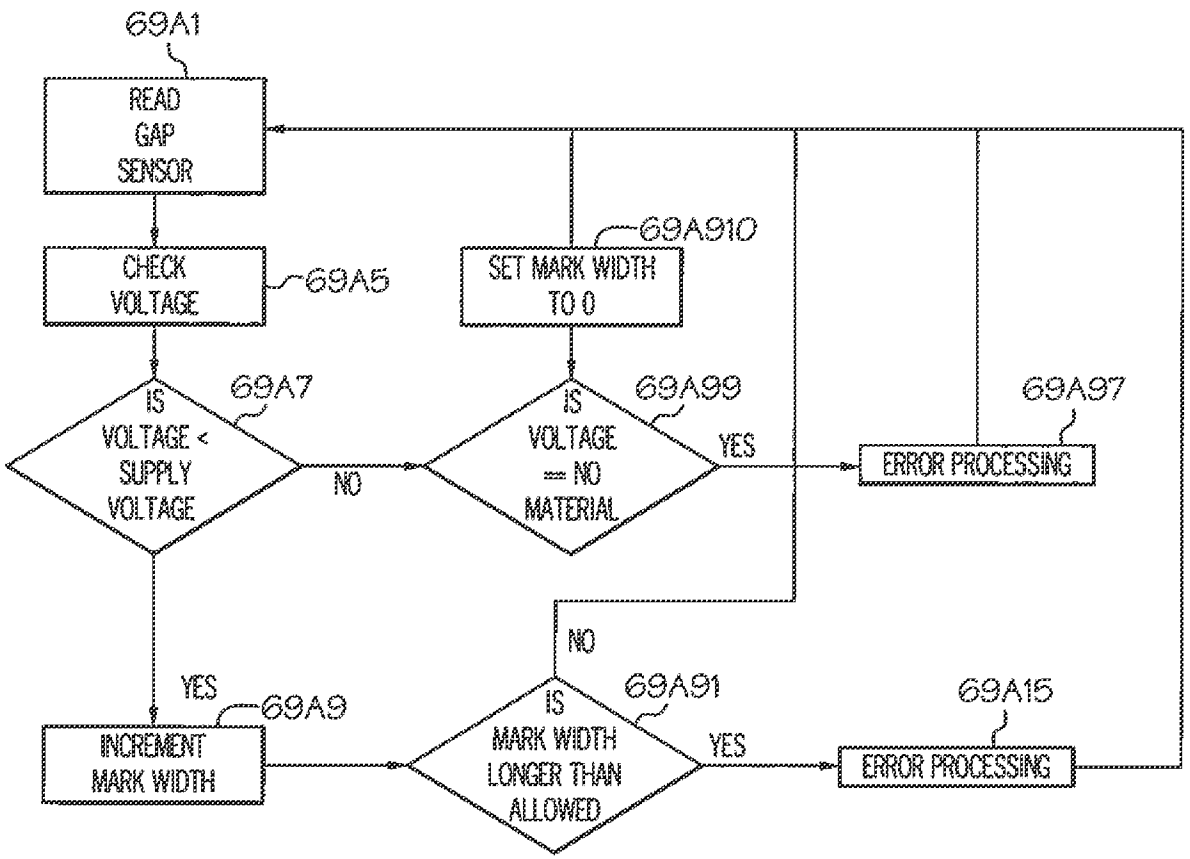
FIG. 34 A illustrates a flowchart of die cut labeling sensing in accordance with the disclosed architecture.

The laminated label supply sensing algorithm is shown in FIG. 34. At 69A1, the logic to read the sensor is entered. At 69A5, the voltage is read and the value is checked against the supply voltage read during calibration (see FIG. 32). At 69A7, if the voltage is less than the reference supply voltage, the user proceeds to 69A9 to increment the mark width. At 69A91, a check is made to see if the mark width is greater (or longer) than the supported mark width. If yes, then the path proceeds to error processing at step 69A15. At 69A15, the mark width is reset to 0 and the user is informed of the issue, then the process returns to read gap sensor at 69A1. If no, then the path proceeds directly to read gap sensor at 69A1. At 69A7, if the voltage is not less than the reference supply voltage, the user proceeds to 69A99 where it is determined if there is no supply in the sensor. If yes, then error processing is entered at 69A97 to inform the user and then returned to read gap sensor at 69A1. If no, then the process is on supply and the mark width is reset to 0 at 69A910, and then returned to read gap sensor at 69A1.

Additionally, during normal operation of the barcode printer, the printer pulls media from a continuous roll to produce the desired output. When the supply is exhausted, the printer could generate a downtime for the printer while the new supply is located and loaded. This is even more true if the printer has been left to run unattended, as even more time can lapse before the out of supply state is remedied. It is desired to enhance the user experience by providing a low supply indicator to give adequate time to prepare for the out of stock condition to minimize the downtime. Since the amount of time to prepare for the out of stock condition may vary per user this invention enables a user to set a specific supply level that he/she wants the sensor to detect. A sensor on a vertical member or mounted on the printer frame will enable the user to set the configurable level amount of remaining supply at which to be notified. In one embodiment we utilize a Time of Flight sensor that is used to measure the absolute distance from the target. The measurement is independent of target reflectance which is advantageous for running black back card stock. In another embedment a reflective sensor was utilized which will measure the light reflected back from the supply.

Figure 17:
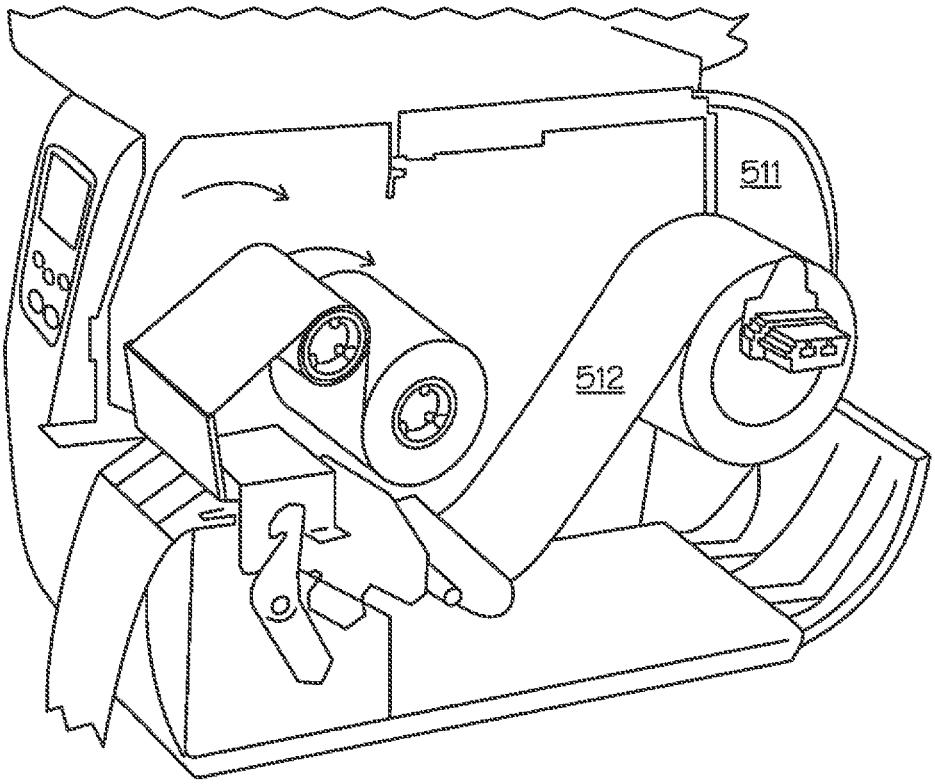
FIG. 17 illustrates a perspective view of a supply holder assembly with a reflective sensor in accordance with the disclosed architecture.
Figure 18:
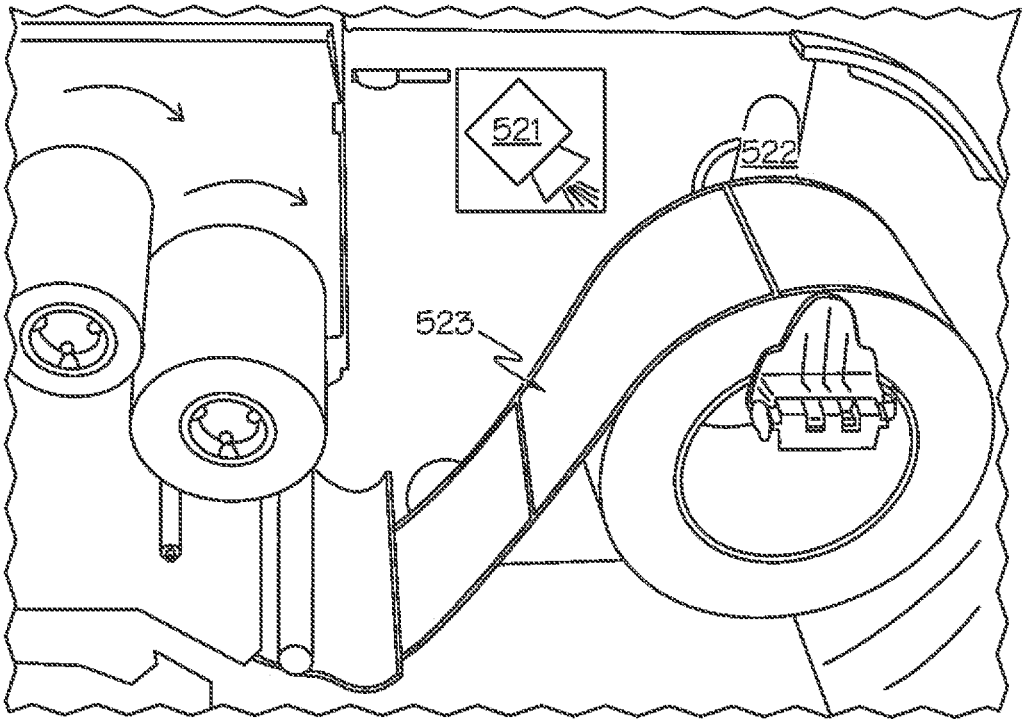
FIG. 18 illustrates a perspective view of a supply holder assembly with a time of flight sensor in accordance with the disclosed architecture.
Figure 52:
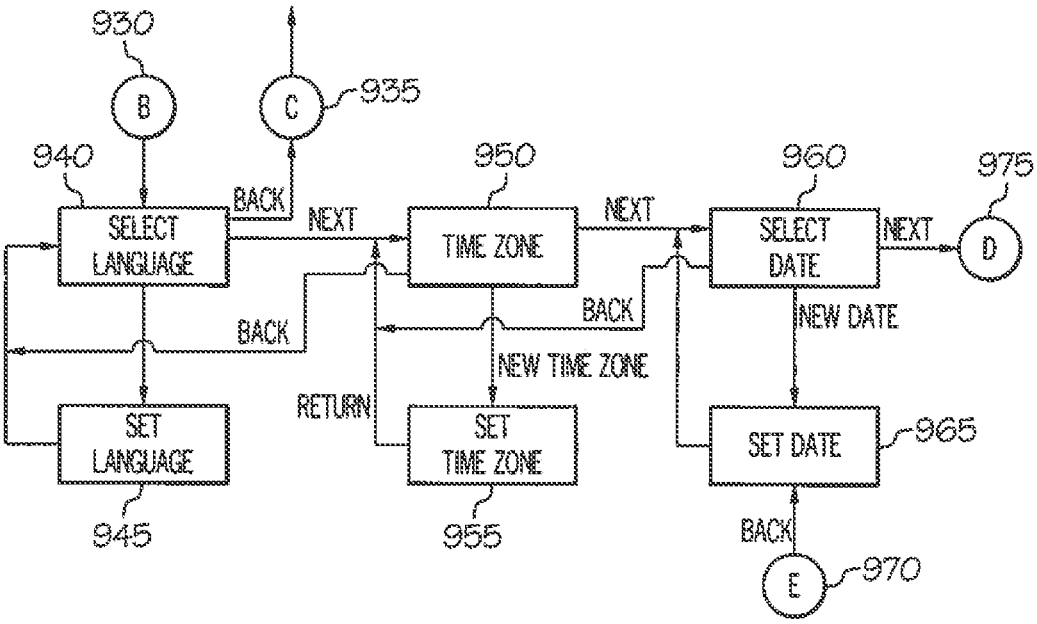
FIG. 52 illustrates further the menu flow chart of FIG. 60.

FIG. 17 displays the supply holder assembly 512 with a reflective sensor 511 mounted on a vertical slide. In a preferred embodiment, a time of flight sensor 521 is mounted adjacent to the supply holder assembly 522, as shown in FIG. 52. Supply roll 523 passes under the sensor 522 sensing the distance between the two. Typically, the sensor used in this application measures the distance irrespective of the reflectance of the object.

Figure 19:
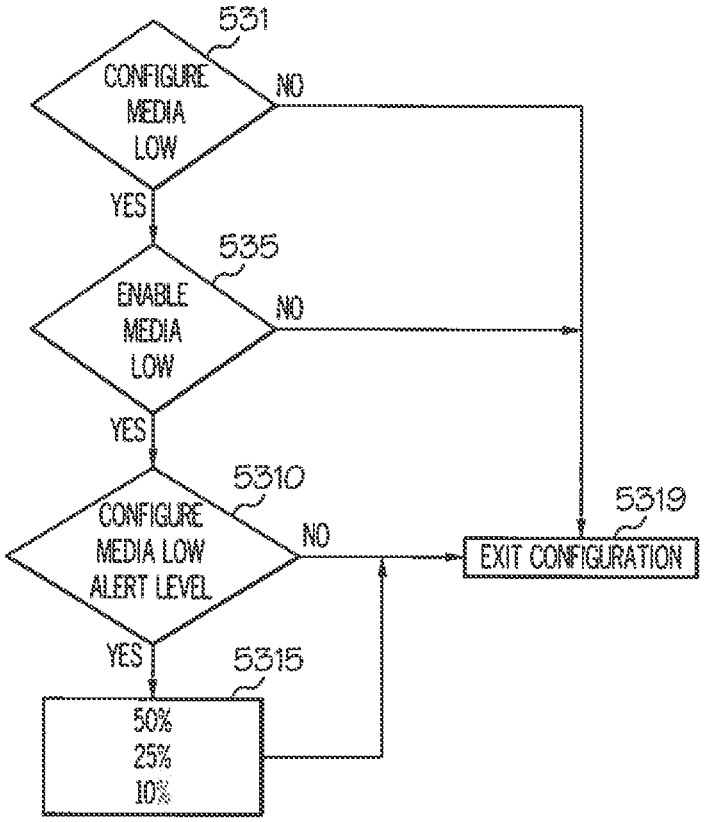
FIG. 19 illustrates a flowchart for configuring media low sensors for time of flight sensors in accordance with the disclosed architecture.

In FIG. 19, the configuration sequence for the media low sensor (time of flight sensors) is shown. At 531, the user indicates a yes or no to wanting to configure the media low sensor. If no, then the configuration is exited at 5319. If yes, then at 535 it is determined whether to enable the media low sensor. If no, then the configuration is exited at 5319. If yes, then at 5310 the user selects the desired level to be notified at, and at 5315 the user picks either 50%, 25%, or 10% which indicates the level of remaining supply before an out of stock condition will exist.

Figure 20:
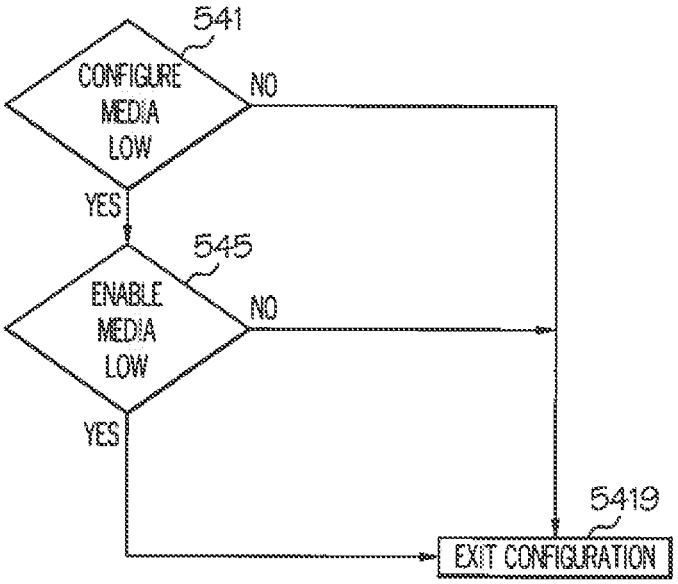
FIG. 20 illustrates a flowchart for configuring media low sensors for reflective sensors in accordance with the disclosed architecture.

FIG. 20 shows the method of configuring the media low sensor for the reflective sensor embodiment. At 541, a user determines if they want to configure the media low sensor. If no, the configuration process exits at 5419. If yes, then the process proceeds to 545 wherein the user can configure the media low, and then enable the sensor to begin sensing the media. In this embodiment the user is required to manually set the sensor at the desired level to identify the out of stock condition.

Figure 21:
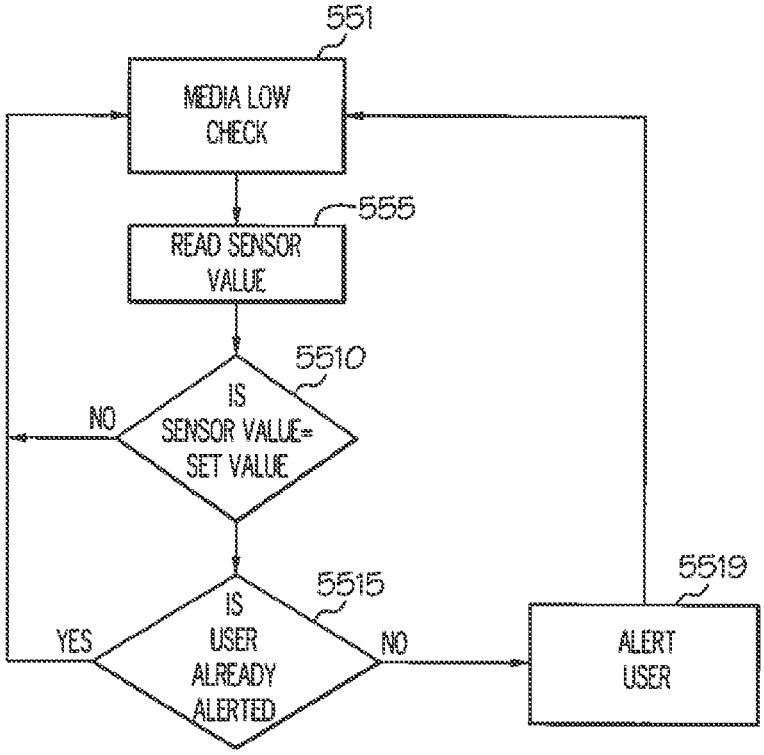
FIG. 21 illustrates a flowchart for checking media low sensors for time of flight sensors in accordance with the disclosed architecture.

In FIG. 21, the media low check for time of flight sensors is shown. At 551, the media low logic is entered. At 555, the time of flight sensor is read to and the process proceeds to 5510 wherein it is determined if the read value matches the set check value. If no, the process returns to the media low check at 551. If yes, the process proceeds to 5515 wherein it is determined if the user has already been notified. If yes, then the process returns to the media low check at 551. If no, then the alert user logic is processed at 5519, and then the process returns to the media low check at 551.

Figure 22:
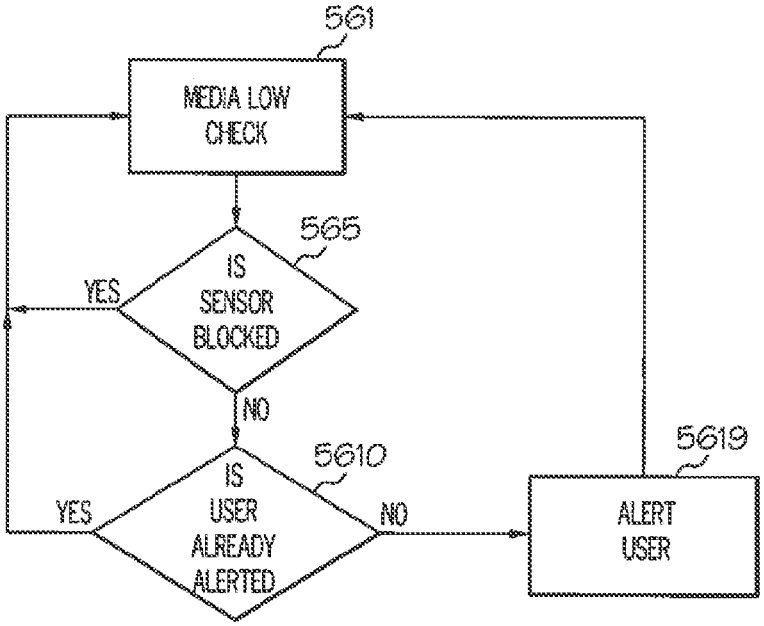
FIG. 22 illustrates a flowchart for checking media low sensors for reflective sensors in accordance with the disclosed architecture.
Figure 51:
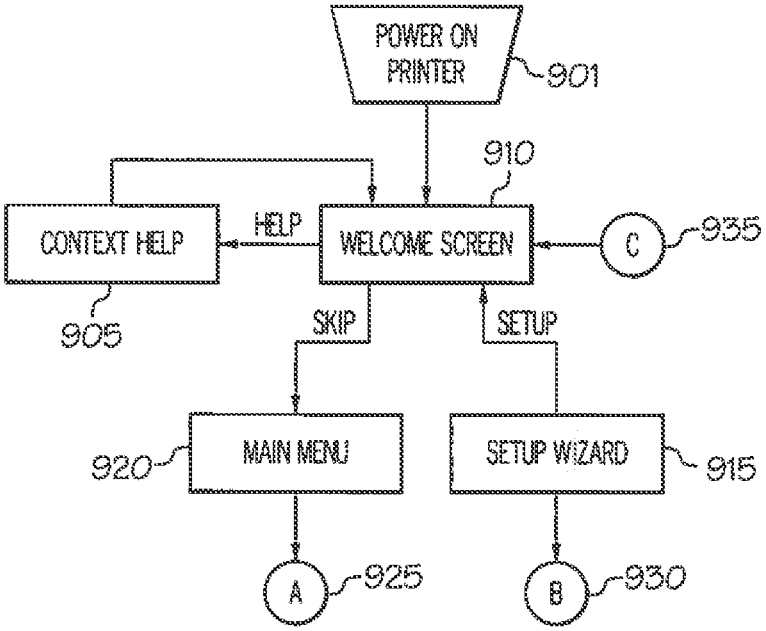
FIG. 51 illustrates a menu flow chart in accordance with the disclosed architecture.

FIG. 22 discloses the media low check method for the reflective sensor shown in FIG. 51 mounted on the adjustable member. In this embodiment, the user manually moves the reflective sensor to the position where notification of low media is desired. At 561, the process begins with low media check. Then, at 565, it is determined if the sensor is blocked. If no, the process returns to media low check at 561. If yes, the process proceeds to 5610 where it is determined if a user is already alerted. If yes, then the process returns to media low check at 561. If no, then the process proceeds to 5619 wherein the user is alerted, and then the process returns to media low check at 561.

Figure 23:
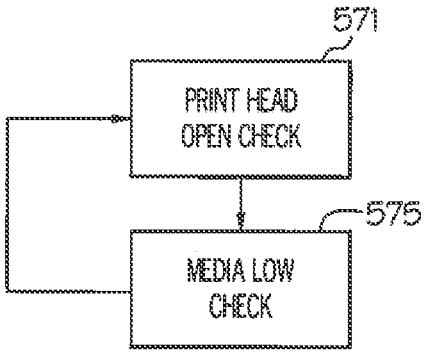
FIG. 23 illustrates a flowchart for resetting values when the print head is open in accordance with the disclosed architecture.
Figure 24:
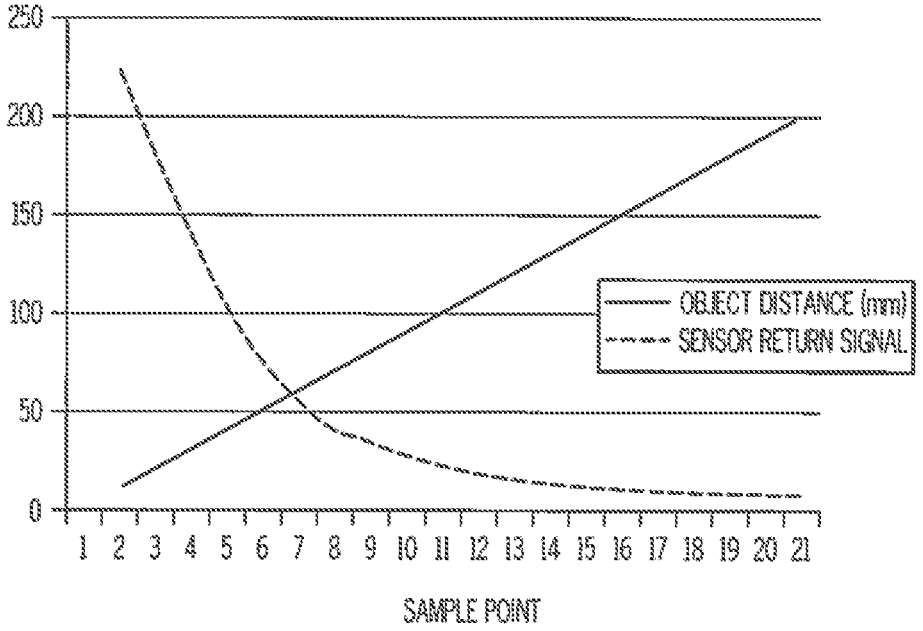
FIG. 24 illustrates a graph of media low sensor measurements for time of flight sensor testing in accordance with the disclosed architecture.

FIG. 23 the media check method when the print head is open. At 571, the print head is opened and the process proceeds to 575 wherein the media low check is performed. When the print head is open, the media low flag is cleared for either embodiment. Further, FIG. 58 discloses media low sensor measurements for time of flight sensor testing.

Additionally, this application discloses an improved printer which comprises a simple, intuitive user-friendly touchscreen interface, is easy to assemble, and has a low cost to repair. Specifically, a wrap-around window is located in the supply hinged cover to enhance a user's ability to see the supply roll. Further, the printer provides an open supply path on a rigid frame, which is easy to manufacture and onto which components can be readily assembled. The printer also provides an improved frame with a rigid side wall on which the ink supply spool and take-up spools can be mounted. Further, a supply spindle for an ink ribbon supply spool and an ink ribbon take-up spindle are mounted on the frame. Additionally, the printer provides a large torque capacity, enhanced ability to reverse motion, and improved determination of ribbon torque by providing more accurate ribbon diameter information.

Figure 40:
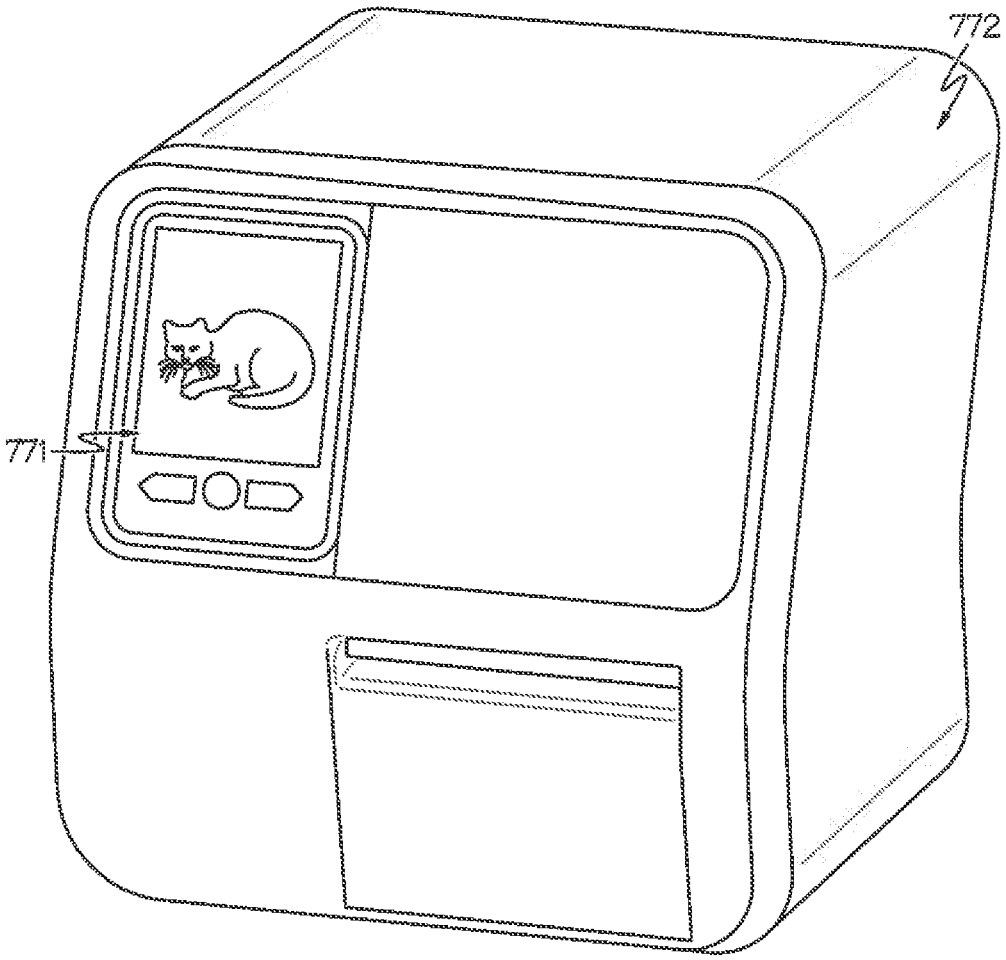
FIG. 40 illustrates a front, perspective view of the printer in accordance with the disclosed architecture.

FIG. 40—depicts a front view of the printer with touch screen and wrap-around viewing window. Reference number 771 indicates the touch screen and reference number 772 is the supply viewing window. The window gives a wrap-around view to provide excellent visibility for the user. FIG. 77 shows the front view of the disclosed printer. 771 the indicated the location of the touch screen and 772 is the supply viewing window. When the printer is power on FIG. 80 is displayed on the touch panel. FIG. 91 will follow the menu structure flow displayed in FIGS. 80-86. It should be noted that the preferred embodiment for setting regional and time settings is through the use of geolocation using a GPS receiver module such as the Linx Technologies F4 Series GPS Receiver Module. By maintaining reference table in the printer for correlating the regional settings with the NMEA output the printer can self-select region of use settings for WiFi, RFID, TimeZone information. Alternately the printer can use geolocation service on a device that is ip connected.

The flow chart is illustrated in FIG. 51 and entered at 901 when the printer is powered on. The welcome screen, 910, is brought up when the power is stable in the printer. From the welcome screen the user can go to context help, 905, main menu, 920, or setup wizard, 915. The context help, 905 is entered when the user touches the help on the screen available actions are explained and then the user can return to welcome screen, 910. Following on from 920 the main menu of the printer is entered, with a view in FIG. 87. The menu flow is explained in flowchart 94.

Figure 43:
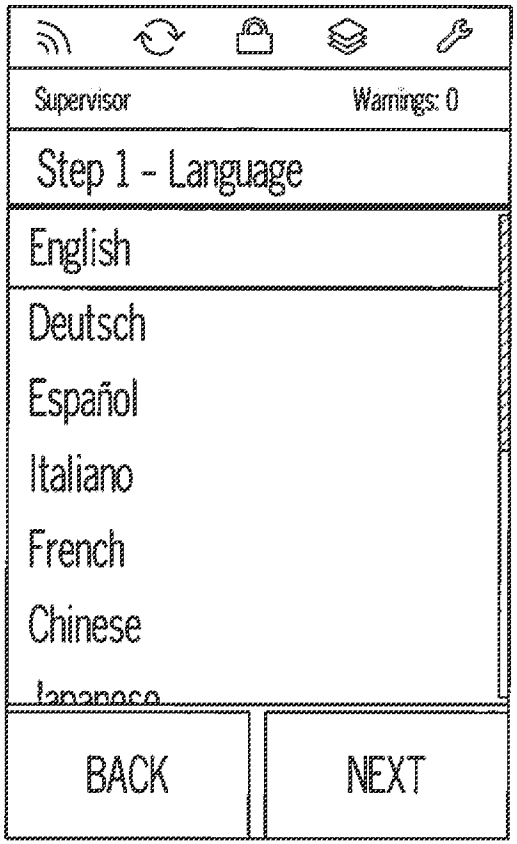
FIG. 43 illustrates a setup language screen in accordance with the disclosed architecture.
Figure 42:
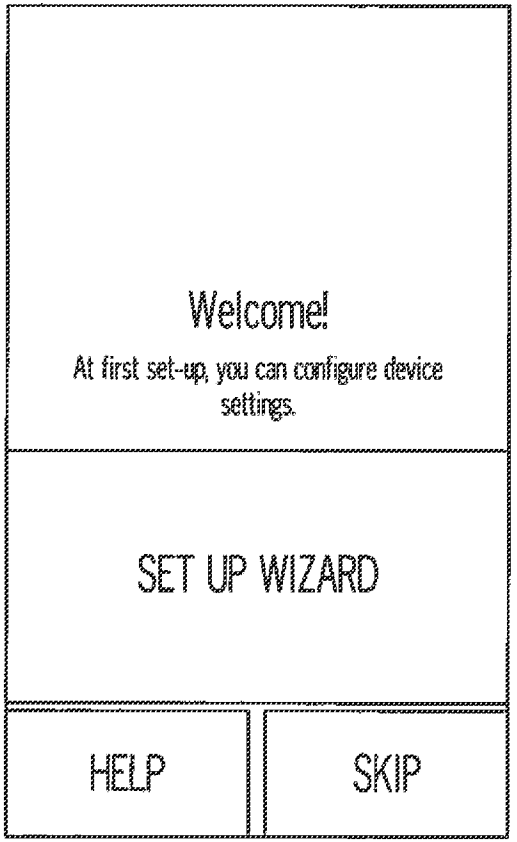
FIG. 42 illustrates a power on screen in accordance with the disclosed architecture.
Figure 45:
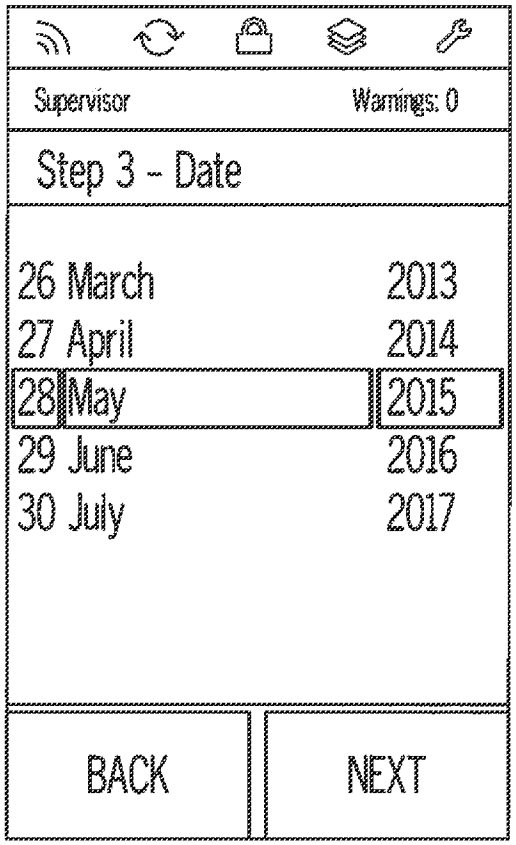
FIG. 45 illustrates a setup date screen in accordance with the disclosed architecture.
Figure 44:
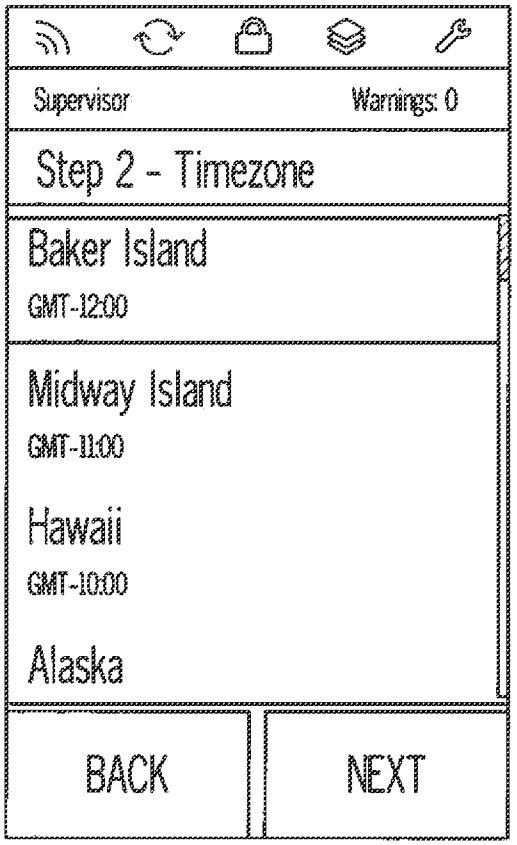
FIG. 44 illustrates a setup time zone screen in accordance with the disclosed architecture.
Figure 47:
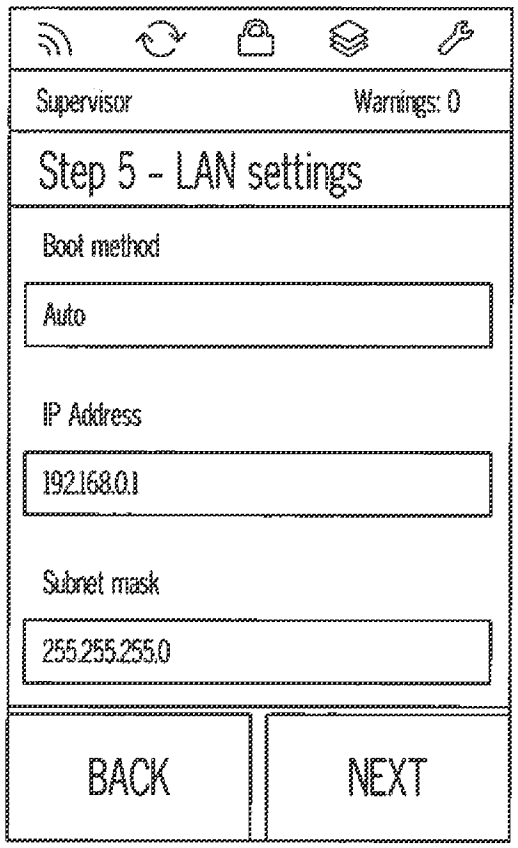
FIG. 47 illustrates a setup language in accordance with the disclosed architecture.
Figure 46:
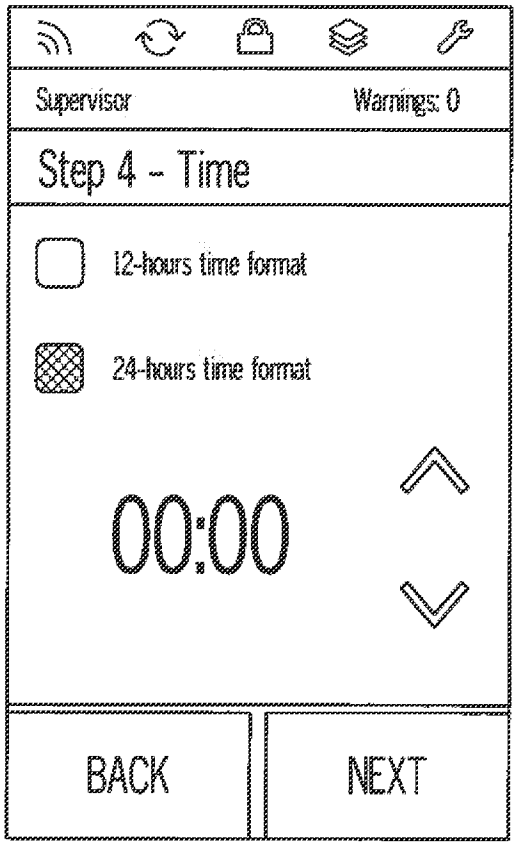
FIG. 46 illustrates a setup time screen in accordance with the disclosed architecture.
Figure 53:
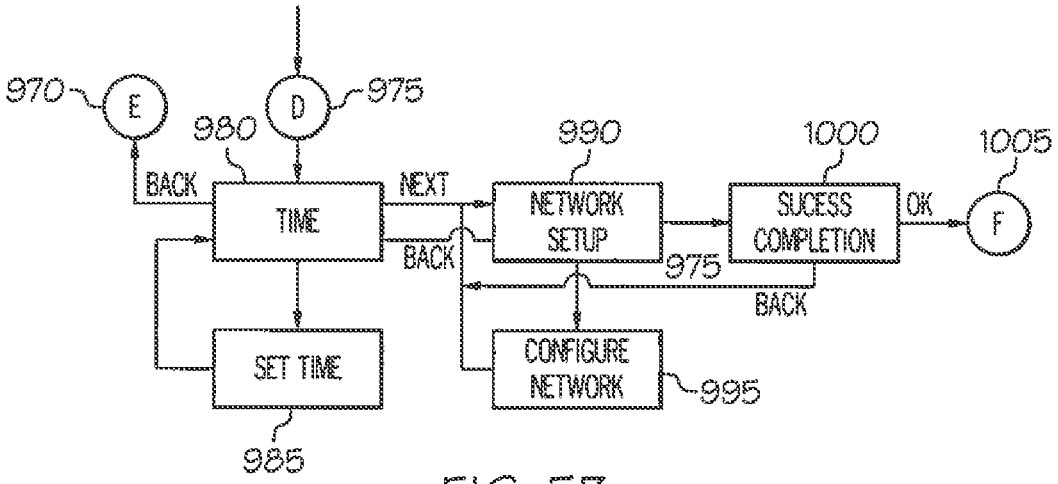
FIG. 53 further illustrates the menu flow chart of FIG. 60.

Refer to 915 for the starting point of the setup wizard which starts at the top of FIG. 92 in 940. A perspective view of the screen is shown in FIG. 42. The Language, 940, screen shown in FIG. 43 entered from the connector 930. In 940 the user decides if he wants to select a language (945), go back (935) or go next (950). Following the next to Time Zone, 950, shown in FIG. 44, the user will have the same choices of going back to Select Language, setting the time zone, 955 or next. Following next path to Select Date, 960, shown in FIG. 45, the user can go back, set date or next. Following the next path through connector 975 the user enters the Time setup selection shown in FIG. 46. In FIG. 53 the flow is shown for the user to enter Time setup shown in FIG. 46. The user can go back through connector 970 to Date, configure time in 985 or go to next Network Setup in 990. Network setup is shown in FIG. 47. From 990 the user can go back to 980, Configure the network parameters or go to the completion screen in 1000. The completion screen is shown in FIG. 86 and reviews the printer configuration. From 1000 the user can return to network configuration 990 or follow the connector to the main screen 1010.

Figure 49:
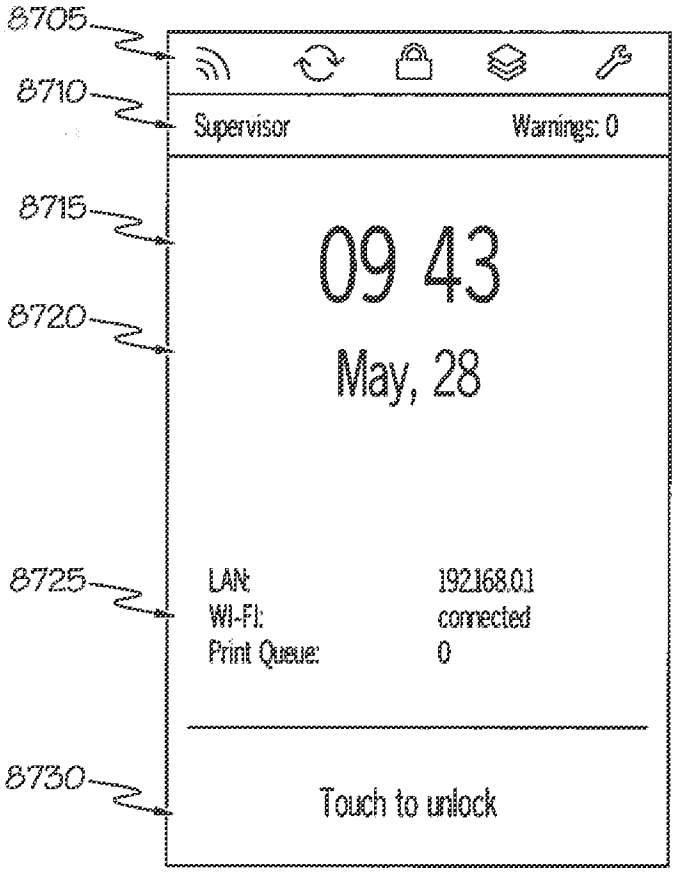
FIG. 49 illustrates an idle screen in accordance with the disclosed architecture.
Figure 48:
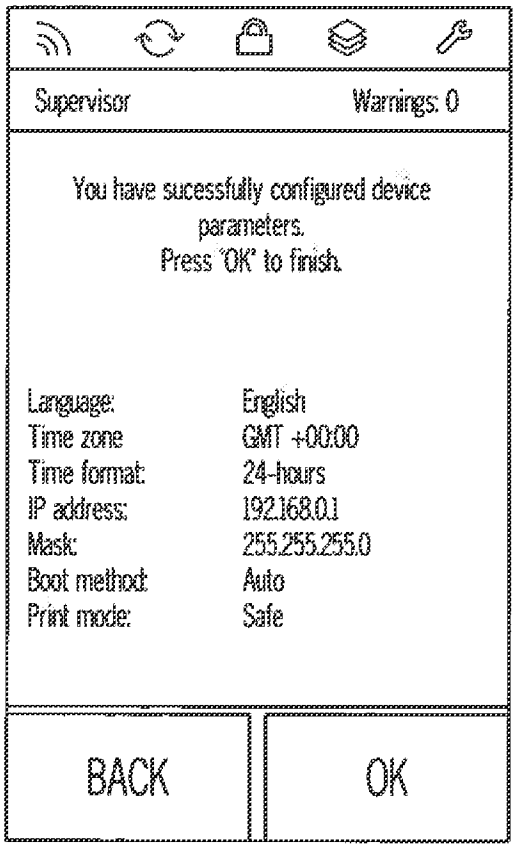
FIG. 48 illustrates a completion screen in accordance with the disclosed architecture.

The main screen shown in FIG. 49 can be entered by following connector 1005 from the printer configuration screen or from following connector 925 A from the startup screen shown in FIG. 80

There are 6 zones on the startup screen shown in FIG. 49. In FIG. 49 you can see 8705. 8705 in the status bar for the printer. We see the wireless signal strength, refresh status, whether the screen is unlocked or unlocked, jobs in queue, current configuration settings. 8710 status line list the current user level and system warnings (low supply, low battery and low ribbon). Referring to 8715 the current time is displayed and referring to 8720 the current date is shown. 8725 shows the network configuration. and touching 8730 will bring up the printer toolbox screen.

Figure 50:
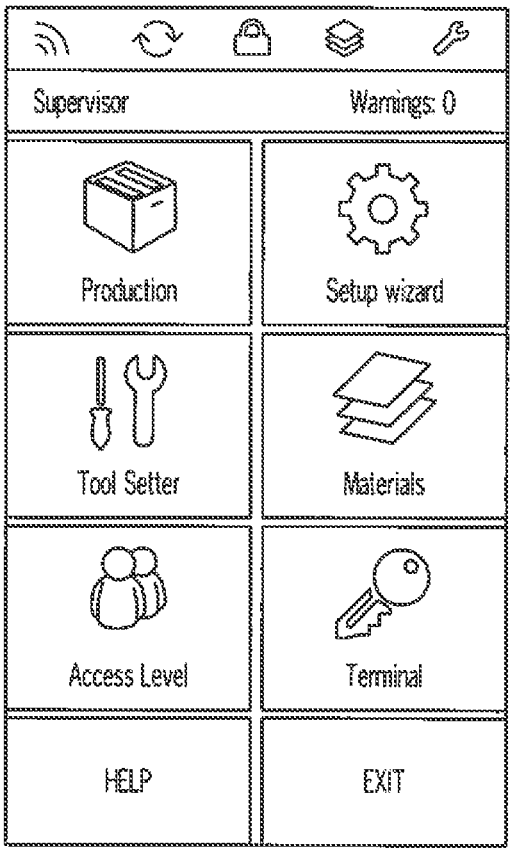
FIG. 50 illustrates a toolbox screen in accordance with the disclosed architecture.
Figure 54:
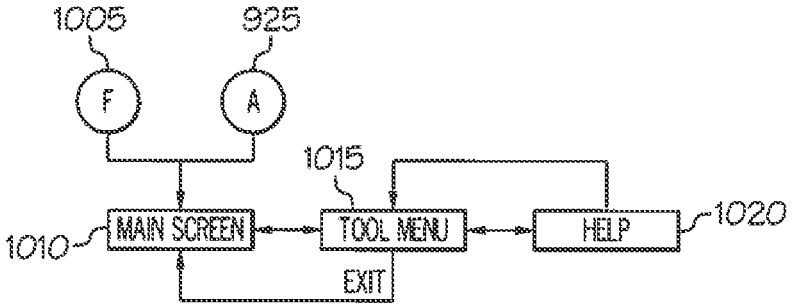
FIG. 54 further illustrates the menu flow chart of FIG. 60.

In FIG. 50 the following toolbox items can be entered. Production configuration, setup wizard, in depth tool settings, material configuration, user access levels and terminal mode. The flow for FIG. 88 can be seen in FIG. 54. Following the Main Screen at 1010 you can enter the Tool Menu. From the tool menu you can access a sub menu, display context help or return to FIG. 49.

FIG. 41 shows the side view of the printer main frame. Reference number 781 indicates the rigid side wall where the brushless direct current (BLDC) motors are mounted for the dual motor ribbon control. Reference number 782 indicates the open print path giving the user easy access to the quick change print head. Typically, brushed direct current motors (BDC) are used, using back EMF in order to calculate ribbon spool diameter to provide torque inputs for smooth ribbon operation. However, this invention incorporates the use of BLDC motors with sensors to provide improved information on ribbon diameter and positional information by measuring the velocity of the motor. The improved information on the ribbon diameter impacts the forward and reverse motion of the ribbon spools in the printer impacting print quality and smoothness of ribbon operation.

Figure 38:
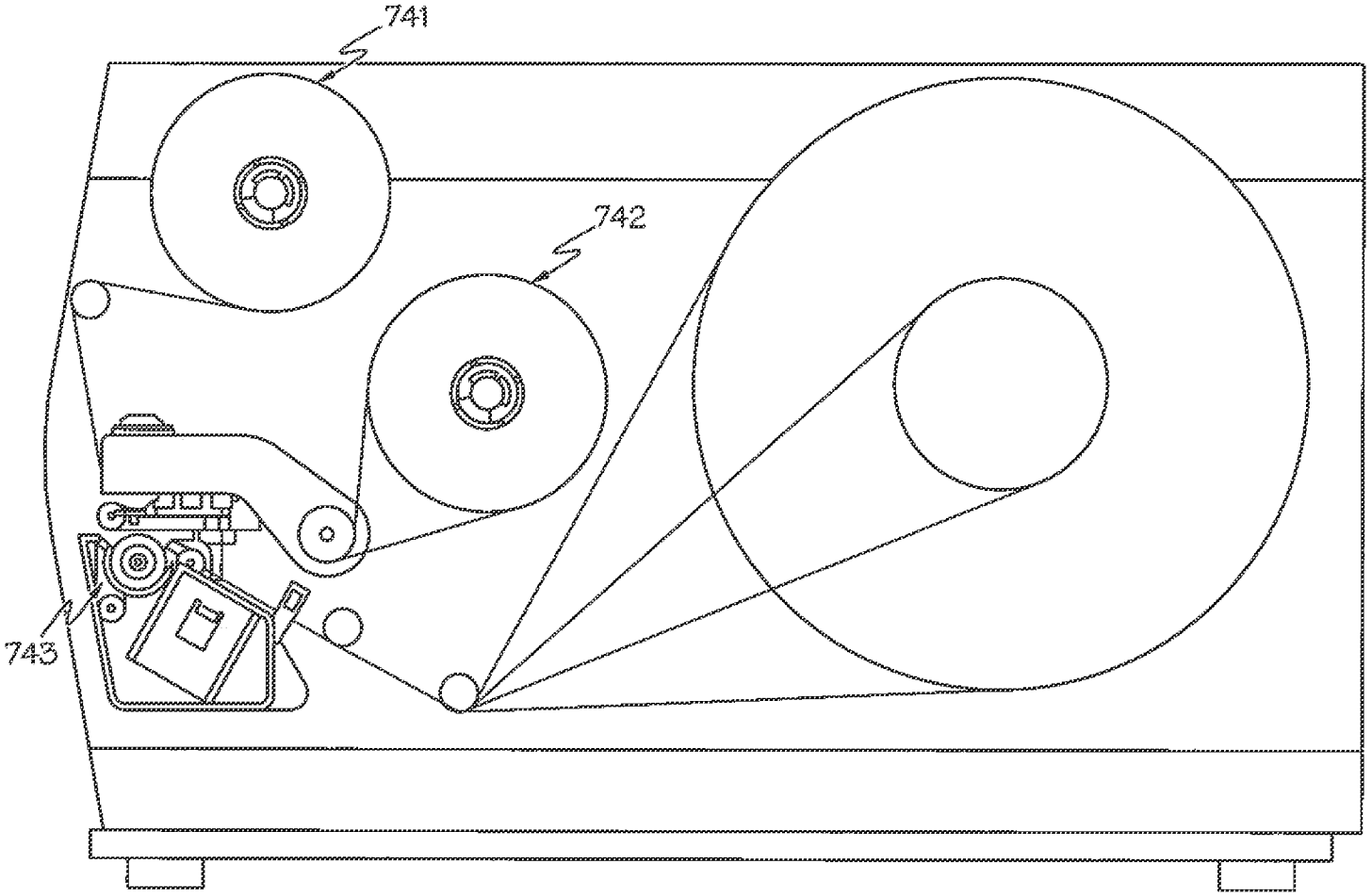
FIG. 38 illustrates a perspective view of the ribbon supply spindle in accordance with the disclosed architecture illustrates a side view of the printer in accordance with the disclosed architecture.
Figure 39:
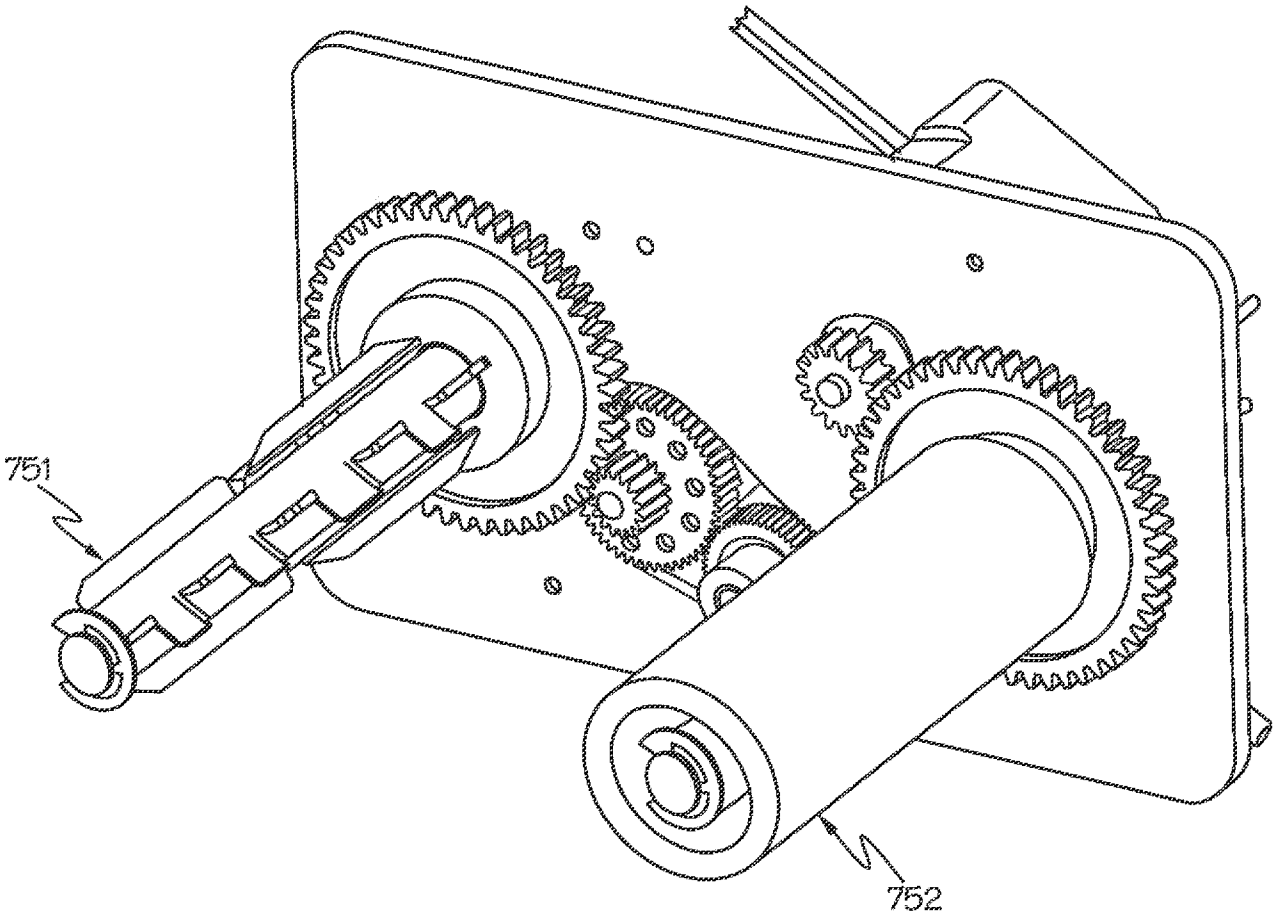
FIG. 39 Take-up and Supply Side Spindle with Cardboard Core

FIG. 38 illustrates the ribbon supply spindle, wherein reference number 743 indicates the platen roller of the printer. The platen roller is the main drive and print location for the printer. Further, for the purpose of the ribbon radius calculation, it is assumed the ribbon is moving at the platen speed when installed and ribbon ink remains on the supply spool as indicated by 742. If the ribbon spool is not installed or the ink film is broken, the supply spool speed will exceed the web speed dictated by the platen drive. If the take-up ribbon spool is full 741 and the end of the ribbon does not delaminate from the supply spool, the supply spool speed will be less than the platen drive. Another view of the configuration is shown in FIG. 39

Figure 35:
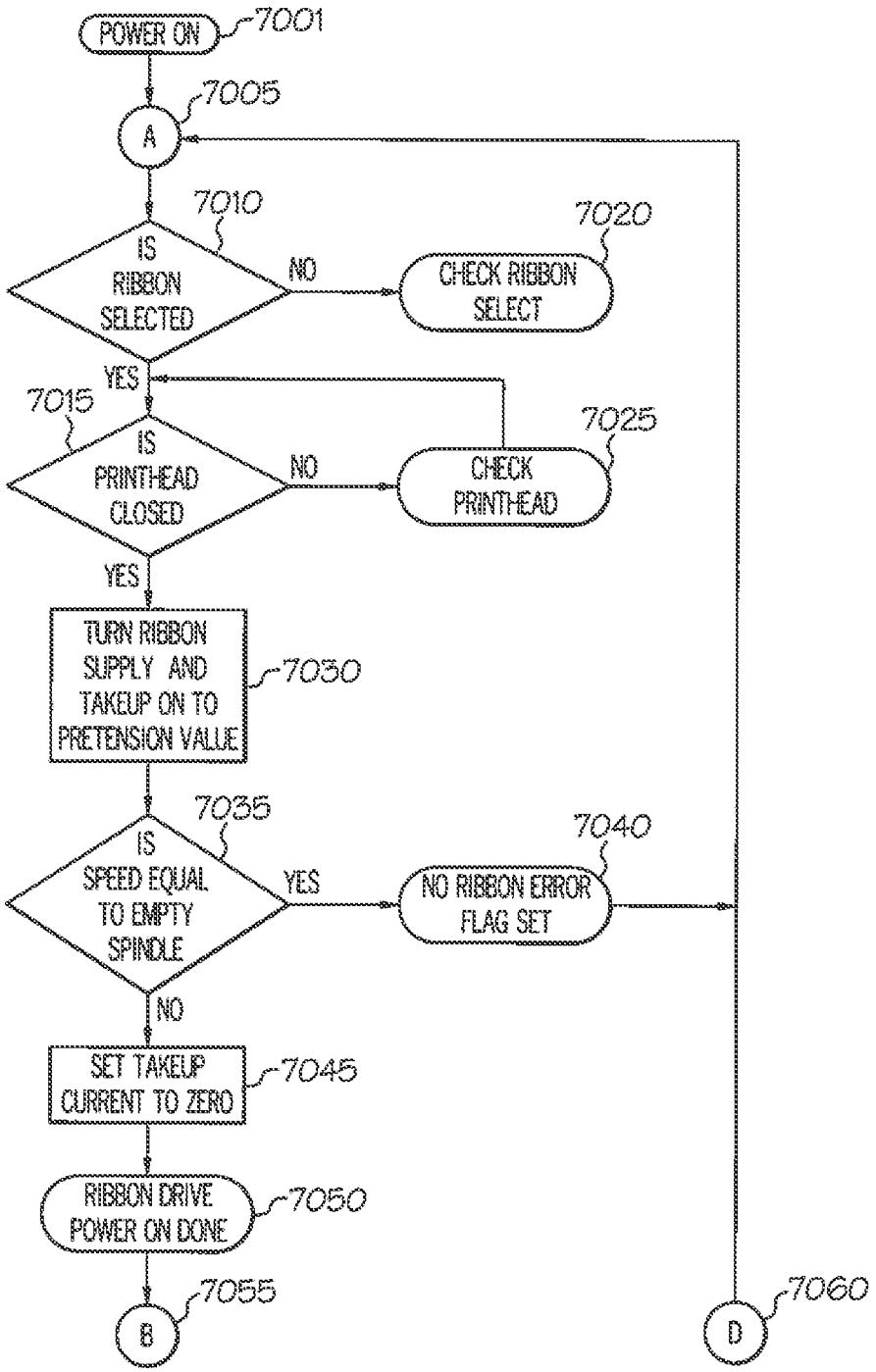
FIG. 35 illustrates a flowchart of a ribbon drive power on sequence in accordance with the disclosed architecture.

FIG. 35 is a flowchart of the power on logic for the ribbon subsystem. At 7001, is the printer power on entry point. At 7005, is a return point to the beginning of the ribbon subsystem initialization. At 7010, it is determined if the ribbon system is enabled or not. For thermal direct supply, no ribbon is required, therefore the logic follows to step 7020 to check if the ribbon was enabled by the user before returning to 7005. If the ribbon system was enabled, then the process proceeds to 7015 wherein it is determined if the print head is closed. If not, the process moves to 7025 to check for print head closed and then loops back around to 7015 if the print head is closed. Once the print head is closed, the process moves to 7030 to turn on the ribbon supply and take-up BLDC motors to a predetermined pretension value. Then, at 7035, it is determined if the supply BLDC speed is equal to empty spindle. If yes, then at 7040, a ribbon has not been installed and a NO ribbon installed process is followed, before returning to 7005. If no, then at 7045, the take-up current is set to zero, and the power on sequence is completed at 7050, and ends at 7055.

Figure 36:
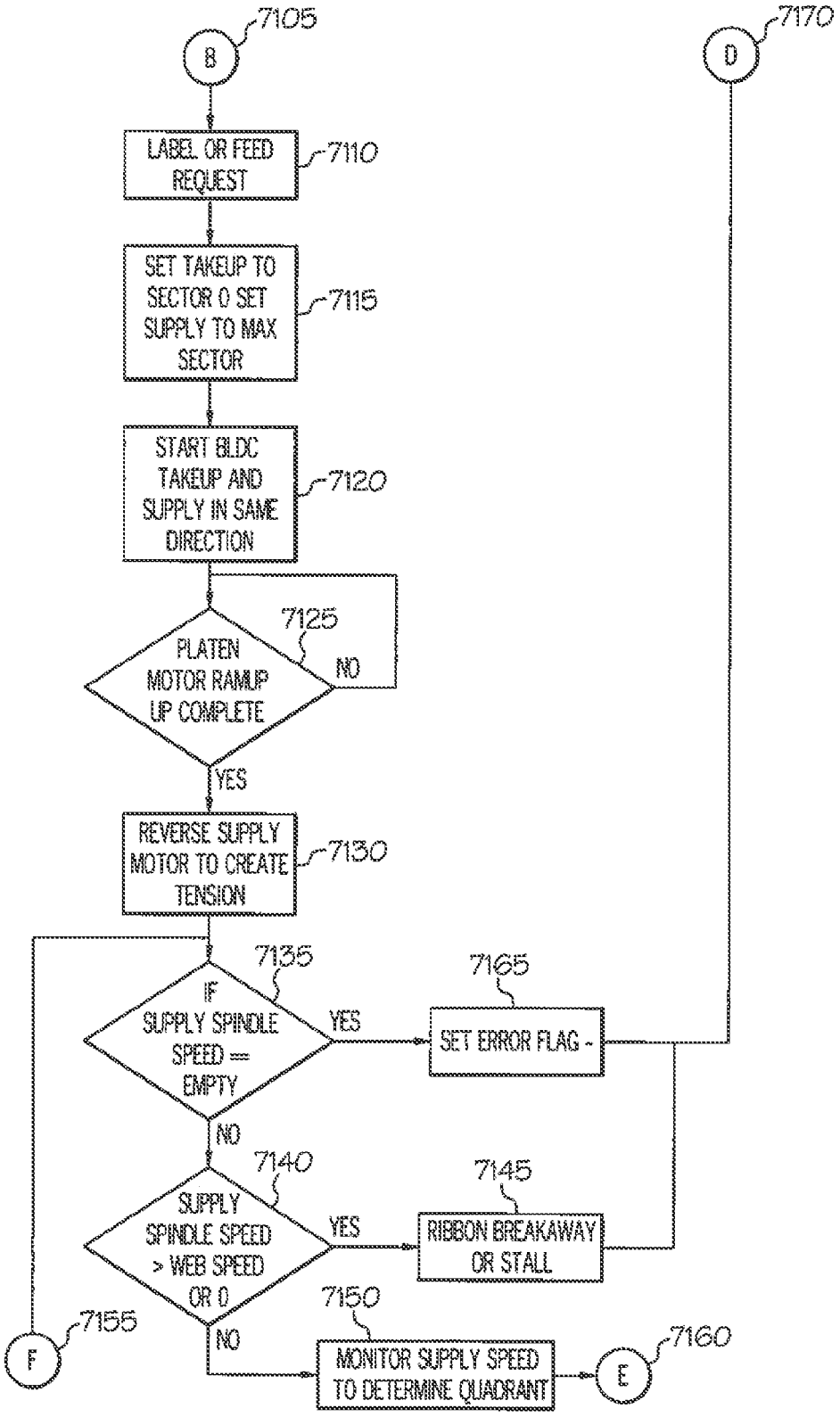
FIG. 36 illustrates a flowchart that continues from FIG. 70 in accordance with the disclosed architecture.

The process continues in FIG. 36, which discloses the label processing sequence. Entering at 7105, which could be a continuance from 7055, the process continues to 7110 where a request to print a label or feed a blank label is entered. At 7115, the take-up BLDC is set to sector 0 and supply BLDC is set to max sector. At 7120, the take-up and supply motors are started with the direction going in the same direction. At 7125, the logic loops until the platen motor ramp up is complete. At 7130, the supply motor is reversed to create tension. If the ramp up sequence is complete, the logic proceeds to 7135 where it is determined if the supply spindle is empty. If yes, a flag is set at 7165 before the process continues to 7170. If the supply side is not empty, the process moves to 7130 where supply spindle speed is determined. If supply spindle speed is greater than web speed or 0, then at 7140, there is a check for a breakaway condition or take-up spool full. If either is true, the error condition is set in 7145, and the process continues to 7170. If supply spindle speed is less than web speed or 0, then at 7140 the ribbon quadrant is determined based on speed of supply spindle, then the process continues to 7160.

Figure 37:
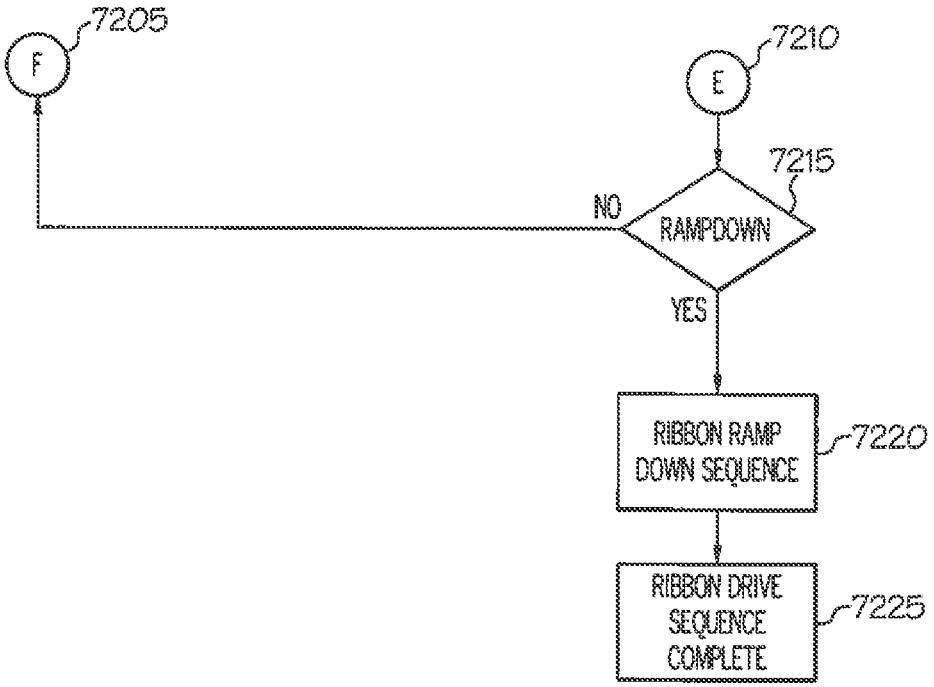
FIG. 37 illustrates a flowchart that continues from FIG. 71 in accordance with the disclosed architecture.

The process continues in FIG. 37, wherein at 7215 a check is made to determine if user is ramping down the ribbon system because of error encountered or end of page reached. If no, then the process proceeds to 7205 which returns to 7155. If yes, then the process proceeds to 7220 wherein a ramp down sequence is followed, and then at 7225 the sequence is complete and exits.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A thermal printer, comprising:

a thermal print head for printing barcodes and alphanumeric information on a web of record members;

a stepper motor that is responsive to a periodic drive signal to advance the web of record members past the print head for printing wherein the drive signal controls speed of the stepper motor;

a controller that comprises a microprocessor which operates in accordance with software routines stored in a memory so as to control operations of the bar code printer;

a plurality of sensors, monitors, and detectors to monitor operating conditions of the bar code printer;

a frame comprising a female receptor with a matched slot for receiving a radial pin; and a platen roller with a bayonet connector and a vertical spring that aligns a shaft of the platen roller and depresses for insertion into the slot and then is pushed upwards into the slot, such that the bayonet connector is no longer free to rotate unless pressure is depressed against the vertical spring to release it from the slot.

2. The printer of claim 1, wherein the bayonet connector comprises a cylindrical male component with a radial pin.

3. The printer of claim 2, wherein the slot is L shaped.

4. The printer of claim 1, wherein the female receptor further comprises at least one spring to secure the male component and female receptor together.

5. The printer of claim 1, further comprising a U-shaped channel and a horizontal spring to secure the platen roller in position.

6. The printer of claim 1, further comprising an easy connector component that accepts the print head.

7. The printer of claim 6, wherein the print head is guided into the easy connector component via a plurality of mechanical guiding pins, which provide positive feedback and are keyed to ensure that a user will insert the print head in a correct location.

8. The printer of claim 7, wherein the easy connector component comprises a mechanical feature to securely hold the print head in position once the print head is engaged with the easy connector component.

9. A thermal printer, comprising:

a thermal print head for printing barcodes and alphanumeric information on a web of record members;

a stepper motor that is responsive to a periodic drive signal to advance the web of record members past the print head for printing; wherein the drive signal controls speed of the stepper motor which in turn controls print speed of the bar code printer;

a controller that comprises a microprocessor which operates in accordance with software routines stored in a memory so as to control operations of the bar code printer;

a plurality of sensors, monitors, and detectors to monitor operating conditions of the bar code printer;

a supply holder assembly for retaining different sizes of supplies; and a ribbon spindle that can accommodate different ribbon cores and the ribbon spindle comprises a retaining pin for securely retaining a cardboard core to the ribbon spindle.

10. The printer of claim 9, wherein the supply holder assembly comprises a supply core adaptor that would be positioned on a supply holder arm in the supply holder assembly.

11. The printer of claim 10, wherein the supply core adaptor comprises a pair of aluminum plates that are positioned on the supply holder arm at different heights depending on size of supply cores being used on printer.

12. The printer of claim 9, wherein the ribbon spindle comprises a mating retention component that securely retains a plastic core to the ribbon spindle.

13. The printer of claim 12, wherein the ribbon spindle comprises a retraction component that retracts the retaining pin when a user turns the retraction component in a counterclockwise direction.

* * * * *